US006640508B2

(12) United States Patent
Lindgren et al.

(10) Patent No.: US 6,640,508 B2
(45) Date of Patent: Nov. 4, 2003

(54) ROOF WINDOW ASSEMBLY AND COMPONENTS

(75) Inventors: Claes Lindgren, Farum (DK); Birgitte Hansen, Valby (DK); Samuel Howard Darmer, Greenwood, SC (US); Morten Falk Reventlow, Frederiksberg (DK); Brent Møller, Gentofte (DK); Lars Erdmann, København (DK)

(73) Assignee: VKR Holding A/S, Søborg (DK)

( * ) Notice: Subject to any disclaimer, the term of this patent is extended or adjusted under 35 U.S.C. 154(b) by 121 days.

(21) Appl. No.: 09/803,669

(22) Filed: Mar. 12, 2001

(65) Prior Publication Data

US 2002/0095884 A1 Jul. 25, 2002

(30) Foreign Application Priority Data

Jan. 19, 2001 (DK) ..... 2001 00105

(51) Int. Cl.[7] ..... E04B 7/18

(52) U.S. Cl. ..... 52/200; 52/72; 52/204.55; 52/213; 52/656.5; 49/504; 49/DIG. 2

(58) Field of Search ..... 52/200, 19, 72, 52/58, 60, 204.55, 213, 215, 656.5; 49/463, 504, 505, DIG. 2

(56) References Cited

U.S. PATENT DOCUMENTS

| | | | | | |
|---|---|---|---|---|---|
| 4,073,097 | A | * | 2/1978 | Jentoft et al. | 52/22 |
| 4,570,394 | A | * | 2/1986 | Jentoft et al. | 52/72 |
| 4,776,141 | A | * | 10/1988 | Powell | 52/200 |
| 5,150,983 | A | * | 9/1992 | Bogenhagen | 403/402 |
| 5,199,234 | A | * | 4/1993 | Guhl | 52/200 |
| 5,544,455 | A | * | 8/1996 | Deblock | 52/200 |
| 5,669,186 | A | * | 9/1997 | Verby et al. | 52/72 |
| 5,682,713 | A | * | 11/1997 | Weiss | 52/200 |
| 5,913,785 | A | | 6/1999 | Möller et al. | |
| 6,052,956 | A | * | 4/2000 | Hoy et al. | 52/200 |
| 6,195,948 | B1 | * | 3/2001 | Lamanna | 52/200 |
| 6,202,373 | B1 | * | 3/2001 | Lindgren | 52/200 |
| 6,263,623 | B1 | * | 7/2001 | Weiss et al. | 52/200 |
| 6,370,828 | B1 | * | 4/2002 | Genschorek | 52/200 |

FOREIGN PATENT DOCUMENTS

| | | |
|---|---|---|
| DE | 36 42 464 | 7/1988 |
| WO | WO 93/11332 | 6/1993 |
| WO | WO 94/00655 | 1/1994 |
| WO | WO 95/28535 | 10/1995 |
| WO | WO 98/22682 | 5/1998 |
| WO | WO 98/22684 | 5/1998 |
| WO | WO 98/22685 | 5/1998 |
| WO | WO 98/22686 | 5/1998 |

* cited by examiner

*Primary Examiner*—Carl D. Friedman
*Assistant Examiner*—Yvonne M. Horton
(74) *Attorney, Agent, or Firm*—Venable LLP; John P. Shannon; Chad C. Anderson

(57) ABSTRACT

A roof window assembly is composed of a window component, a main frame component and, optionally, an integrated flashing component. The window component may be used independently and without modifications for a roof window installation employing a curb-frame. The window component features a novel design with an glazing element fitted in a profiled sheet metal frame, which can be made from a single continuous sheet metal profile bent into a polygonal frame shape with corner junctions. In both fixed and ventilating versions of the roof window assembly identical connecting members into open mutual engagement at the top side of the window and main frame components provides for easy mounting and dismounting of the window component with respect to the main frame component. The flashing component comprises a rigid flashing frame arrangeable against outer side faces of the main frame component and foldable resilient side flashing sheets, which can be folded to allow packing of the flashing component together with the window and main frame components into a single unit comprising all components needed for installation of the roof window assembly.

58 Claims, 21 Drawing Sheets

ROOF WINDOW ASSEMBLY AND COMPONENTS

CROSS-REFERENCE TO RELATED APPLICATIONS

The present application claims the benefit of priority from Danish patent application No. PA 2001 00105 filed on Jan. 19, 2001.

1. Field of the Invention

The present invention relates to roof window installations and assemblies and components for use therein. In particular, the invention relates to a novel design and structure of a window component, which can be identically used in various types of roof window installations and assemblies and a roof window assembly comprising such a window component together with a main frame component, optionally also including an integrated flashing component, as well as connecting, mounting and positioning members needed for installation of the assembly in a roof structure.

2. Background of the Invention

Window assemblies developed and designed particularly for installation in more or less inclined roof surfaces are well known in the art. Among numerous examples disclosed in the art reference could be made e.g. to the roof window assemblies disclosed in U.S. Pat. No. 5,913,785 and published International Patent Applications WO 98/22682, WO 98/22684, WO 98/22685 and WO 98/22686.

In general, such window assemblies include a main frame structure secured to supporting means of the roof structures and a framed window component in connection therewith, either permanently to provide a fixed window or by some kind of pivotal connection to allow turning of the window component with respect to the main frame between a closed position and ventilating positions which may be confined within a specified opening range.

Common main frame structures include e.g. so-called curb frames, which are frequently made in situ at the site of installation in extension of an underlying light shaft extending through the roof structure towards an internal inclined wall or ceiling. A main frame structure may also, however, be supplied in ready-made form as part of a window assembly in the form of a main frame component to be arranged by so-called deck-mounting against external supporting members of the roof structure around a window opening formed therein.

The main frame structure is frequently made of wood profiles e.g. forming top, side an bottom members of a rectangular frame configuration and covered on externally exposed side faces by flashing members providing weather protection to the wood profiles and securing a tight connection or joint with the roof covering surrounding the window.

Whereas in many designs wood profiles are also used for the framing or sash structure of the window component as disclosed e.g. in above-mentioned WO publication WO 98/22684, the desirability of reducing weight and simplifying production have also resulted in window components with framing or sash structures made of sheet metal profiles, typically of aluminum, formed into desired cross-sectional profile shapes as disclosed e.g. in the above-mentioned U.S. Pat. No. 5,913,785 and WO publications WO 98/22682, WO 98/22685 and WO 98/22686.

BRIEF SUMMARY OF THE INVENTION

In prior art designs of roof window assemblies the main frame structure as well as the framing or sash structure of the window component are frequently composed of top, side and bottom members of different profile shapes. By way of example, in the case of a window assembly with a ventilating, i.e. openable, window component with a framing or sash structure of sheet metal profiles a different profile shape may be required for the top member compared to the profile shape of the side and bottom members in view of the required functionality of forming a hinge connection at the top side of the window assembly.

It is a primary object of the invention to provide a window component for use in roof window installations which can be easily connected with main frame structures of different designs including curb-mounted arrangements as well as ready made main frame components for deck-mounting.

It is a further object of the invention to provide a window component for use in roof window installations offering a particular simplification of production by use of a single continuous sheet metal profile to form frames of various polygonal configurations and sizes.

Moreover, it is an object of the invention to provide a window component and a roof window assembly with integrated engaging means for an external and/or internal screening accessory.

It is a still further object of the invention to provide a roof window assembly with a main frame component for connection with a window component in either fixed or ventilating versions and offering a wide going simplification of production useful for production of an overall product program of roof window assemblies of various designs.

According to a first aspect of the invention a window component for use in a roof window installation is provided, comprising a glazing element with external and internal major surfaces and a closed substantially polygonal perimeter composed of side edges forming angles with each other and a window frame engaging edge zones at said external major surface of the glazing element along all sides thereof, said window frame being made of profile material having throughout its length the same substantially L-shaped cross-section comprising a first profile wall for engagement with said edge zones at said one surface of the glazing element and a second profile wall extending generally at substantially right angles to said first profile wall and having an internal side facing the side edges of the glazing element in substantial parallel relationship and with a relatively small clearance thereto, said first profile wall having a shallow trough-shaped cross section between its junction with the second profile wall and a free edge forming a rest for the glazing element, said second profile providing at an external side thereof a transverse inwards recess extending in the longitudinal direction of the frame, said glazing element being permanently connected with said window frame solely by a strip of an adhesive compound interposed between each of said edge zones of the external major surface of the glazing element and the first profile wall of the window frame without covering said side edge of the glazing element.

According to a second aspect of the invention a roof window assembly is provided, comprising a main frame component for stationary connection with supporting means of a roof structure and composed of a top member, side members and a bottom member in a rectangular configuration, of which at least the profiles for the top and side members have upper side faces defining a common window plane, and a substantially rectangular window member comprising a glazing element with external and internal major surfaces and a window frame engaging edge zones at one of said major surfaces of the glazing element along all sides thereof, said window frame being made of profile material having throughout its length the same substantially L-shaped cross-section comprising a first profile wall for engagement with said edge zones at said external major surface of the glazing element and a second profile wall extending generally at substantially right angles to said first profile wall and having an internal side facing side edges of the glazing element in substantial parallel relationship and with a relatively small clearance thereto, said first profile wall having a shallow trough-shaped cross section between its junction with the second profile wall and a free edge forming a rest for the glazing element, said second profile wall providing at an external side thereof a transverse inwards recess extending in the longitudinal direction of the frame, said glazing element being permanently connected with said window frame solely by a strip of an adhesive compound interposed between each of said edge zones of the external major surface of the insulating glazing element and the first profile wall of the window frame, edges zones of said internal major surface of the glazing element of said window component resting against said upper side faces of the main frame component with a gasket member interposed there between.

Structural and operational details of preferred designs of roof window assemblies and components embodying the invention and advantages obtained thereby will become apparent from the appended drawings and the detailed description to follow.

BRIEF DESCRIPTION OF THE SEVERAL VIEWS OF THE DRAWING

Preferred embodiments of a roof window assembly according to the invention and components thereof will now be explained with reference to the appended drawings, in which.

DETAILED DESCRIPTION OF THE INVENTION

Figure 1:
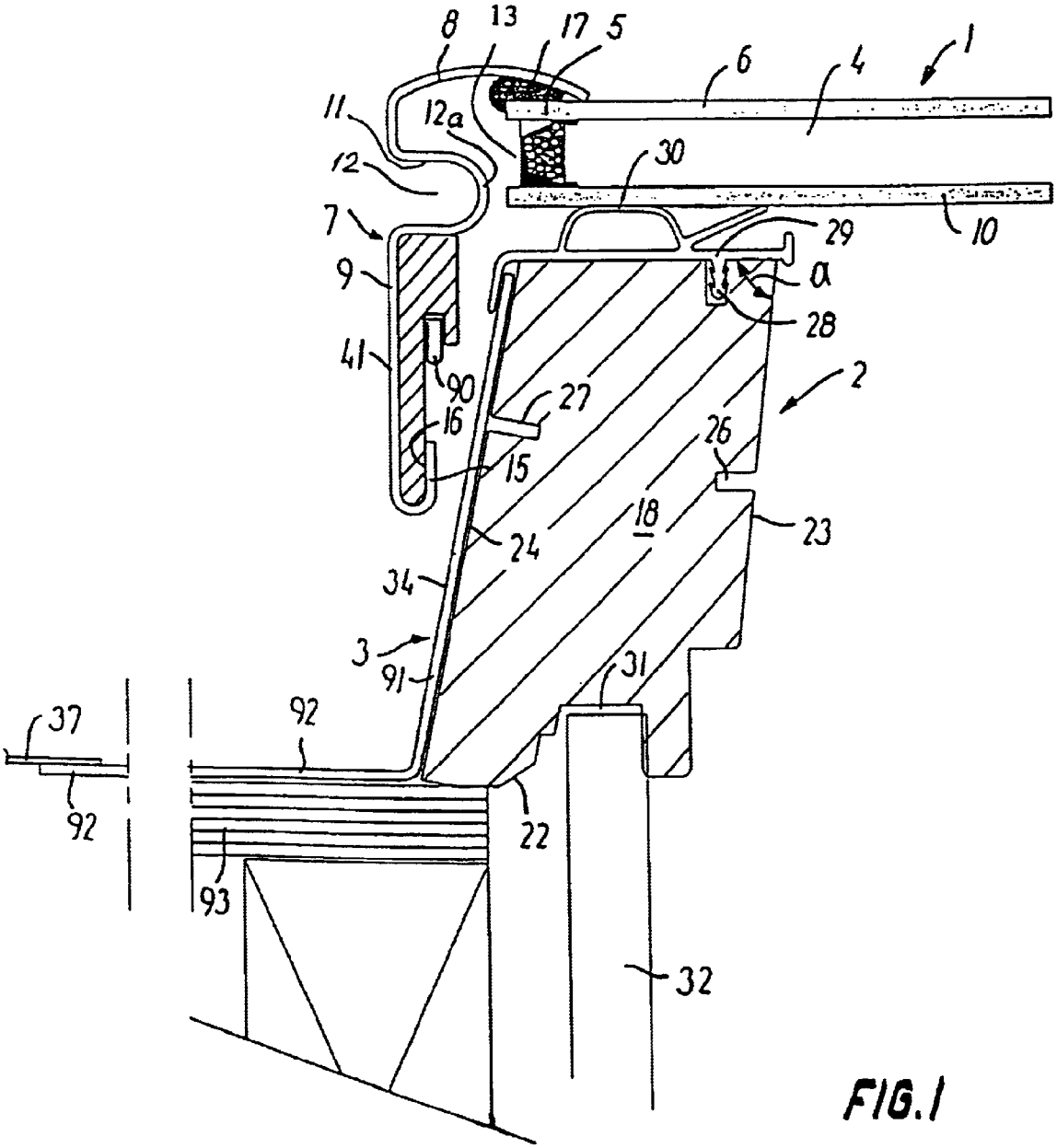
FIGS. 1 to 3 are sectional views of an embodiment of a rectangular roof window assembly for deck-mounting according to the invention intersecting a side member, a top member and a bottom member, respectively, of a main frame component thereof.
Figure 2:
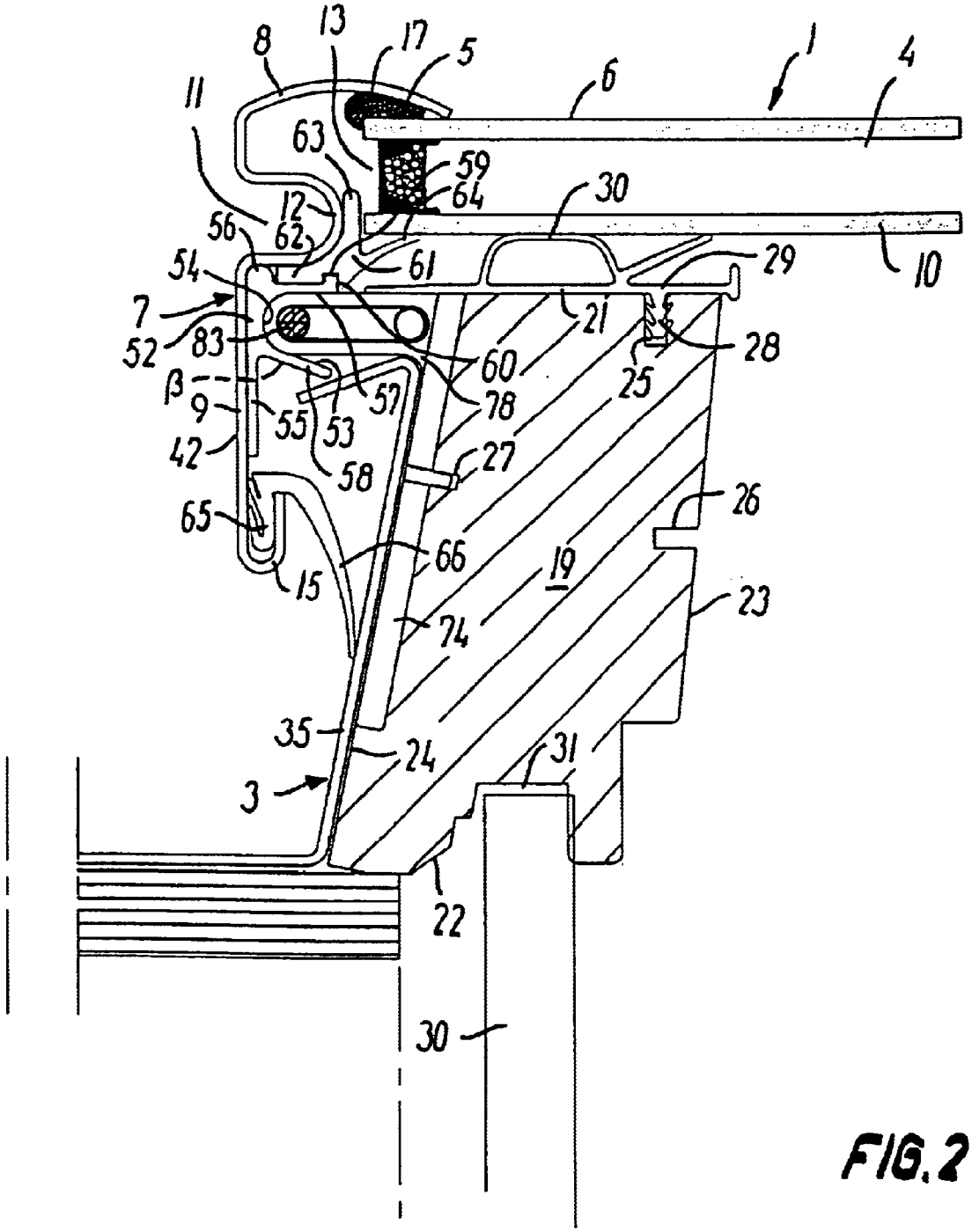
Figure 3:
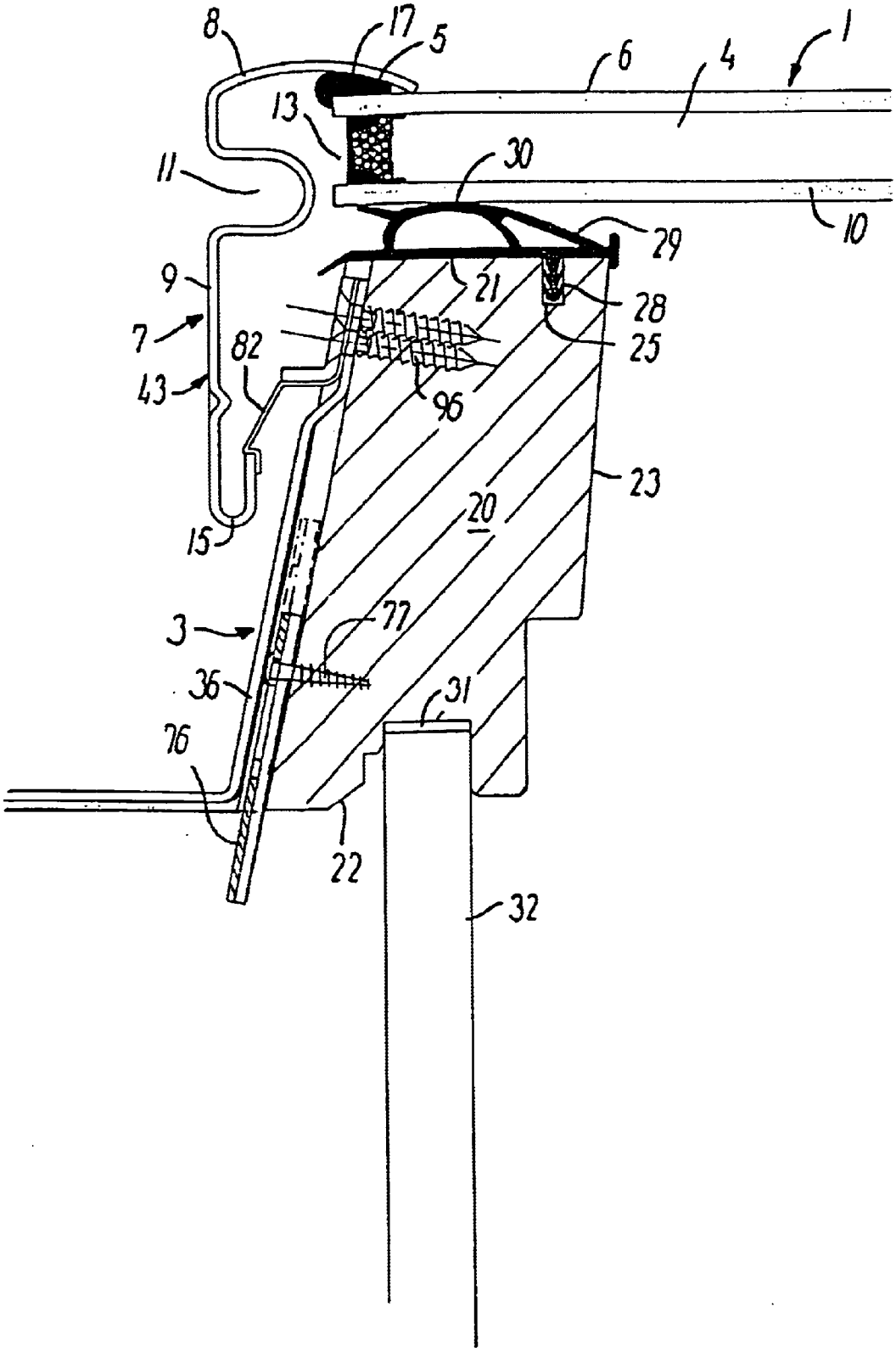

As shown in the sectional views in FIGS. 1 to 3, the main components of a roof window assembly embodying the invention may comprise a window component 1, a main frame component 2 and a flashing component 3.

In the illustrated embodiment the window component 1 to be further explained in the following with reference to FIGS. 5 to 10 comprises an insulating glazing element 4, which would in most cases be of rectangular configuration, but could for the purposes of the invention be of any regular or irregular polygonal perimeter configuration. The glazing element 4 could also, however, be a non-insulating element e.g. comprising a single glass layer or be made of a transparent plastic material for use e.g. in a skylight installation.

On all sides of the glazing element 4, edge zones 5 of the external major surface 6 of the glazing element are engaged by a window frame 7, which in the illustrated embodiment is made of sheet metal profile such as aluminum profile of a thickness of e.g. 1.5 mm. The frame could alternatively be made, however, from an extruded metal profile or from plastic profile material.

Throughout its perimeter length the window frame 7 is formed with the same generally L-shaped cross-section comprising a first profile wall 8 for engagement with the edge zones 5 of the glazing element and a second profile wall 9 extending generally at substantially right angles to the first profile wall 8 and substantially parallel to the perimeter sides of the glazing element 4.

Between its corner junction with the second profile wall 9 and a free edge forming a rest for the glazing element 4 the first profile wall 8 is formed with a shallow through-shaped cross-section, e.g. as illustrated in the form of a substantially part-cylindrical curvature.

In the illustrated embodiment, the second profile wall 9 is formed at a separation from the first profile wall 8 determined by the thickness of the glazing element 4 between the external major surface 6 and an internal major surface 10 thereof, with a transverse inwards recess 11 provided by a relatively narrow groove-like longitudinal depression 12 having a bottom section 12*a* positioned substantially opposite a side edge 13 of the glazing element 4 with a relatively small clearance 14 thereto.

As further illustrated the second profile wall 9 of the window frame 7 is formed along its lower free edge remote from the first profile wall 8 with a bent edge flange 15 forming a track 16 extending substantially parallel to the depression 11.

The glazing element 4 is permanently connected with the window frame 7 solely by a strip 17 of an adhesive compound interposed between all edge zones 5 of the glazing element 4 and the trough-shaped first profile wall 8 of the window frame.

In the illustrated rectangular configuration, the main frame component 2 to be further explained in the following with reference to FIGS. 11 to 15 is generally composed of two side members 18, a top member 19 and a bottom member 20 made of wood profiles. The side, top and bottom members of the main frame component could also be made wholly or in part, however, of metallic profiles or profiles of plastic material.

At least for the side and top members 18 and 19 and, for a main frame component for use in a fixed, i.e. not openable window assembly, also for the bottom member 20 the main frame profiles have the same cross-sectional shape, generally in the form of a parallelogram as known per se from the above-mentioned prior art references WO 98/22682, WO 98,22685 and WO 98/22686, with a first pair of substantially parallel sides forming upper and lower side faces 21 and 22 of the frame member and a second pair of substantially parallel sides forming inner and outer side faces 23 and 24 and inclined with respect to the first pair of sides 21 and 22 with a minor included angle $\alpha$ in the range from 40° to 85°, e.g. as illustrated a minor included angle $\alpha$ of 79°.

In each of the upper, inner and outer side faces 21, 23 and 24, respectively, of the side, top and bottom members 18 to 20 of the main frame component 2, a relatively narrow longitudinal track 25, 26 and 27, respectively, is formed. In the longitudinal tracks 25 in the upper side faces 21 of the main frame members, which together define a common window plane, a projecting rib part 28 of an elastomeric gasket member 29 interposed between the main frame component 2 and edge zones 30 of the internal major surface 10 of the glazing element 4 of the window member 1 is mounted. As will be further explained in the following, the longitudinal tracks 26 and 27 formed in the inner and outer side faces 23 and 24, respectively, are provided to assist in mounting of connecting and mounting members which may form part of the roof window assembly or in the installation of an internal screening accessory for the window assembly.

In the lower side face 22 of each of the side, top and bottom members 18 to 20 of the main frame component, a longitudinal groove 31 may be formed for connection with a lining panel 32 forming part of an internal lining for the window opening, in which the roof window assembly is mounted.

In the illustrated embodiment, the flashing component 3 to be further explained in the following with reference to FIG. 17 comprises a rectangular flashing frame 33 of a substantially rigid material, such as aluminum sheet profiles forming interconnected side, top and bottom members 34, 35 and 36, respectively, arranged against the side, top and bottom members 18, 19 and 20, respectively, of the main frame component 2, and side flashing sheets 37 of a resiliently foldable material such as an elastomeric material projecting from the side members 34 of the flashing frame 30.

Figure 4:
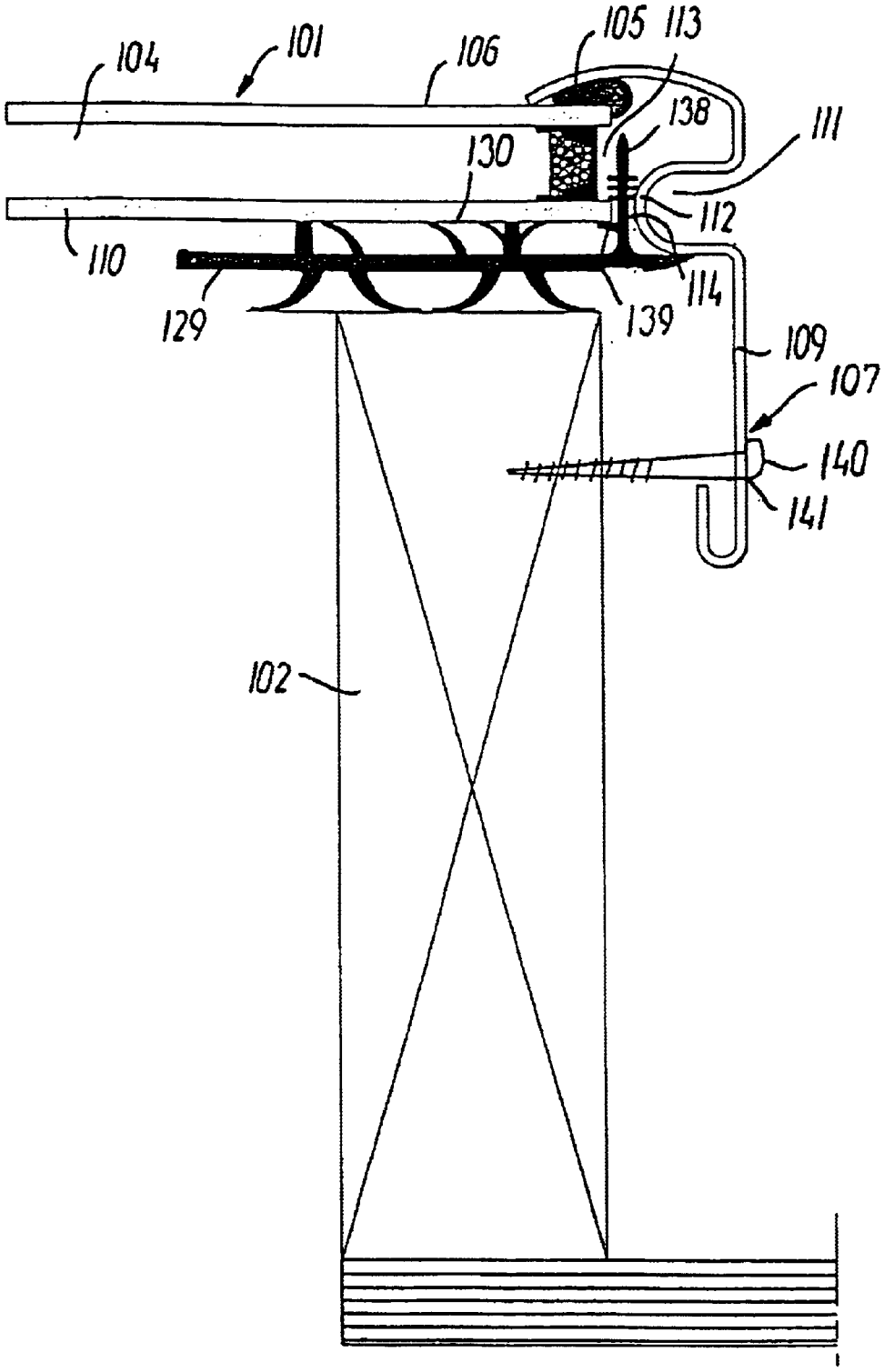
FIG. 4 is a sectional view of a roof window installation with a window member according to the invention mounted on a curb frame.

In the sectional view in FIG. 4, a window component 101 of a structure and configuration generally identical with the window component 1 in FIGS. 1 to 3 is shown in connection with a curb frame 102, which is a frequently occurring frame type, typically made in situ at the site of installation and is built up of conventional wood profiles. For this type of roof or skylight installation the window component 101 may be supplied with an elastomeric gasket member 129 retained in engagement with edge zones 130 of the internal major surface 110 of the glazing element 104 by retainment of a projecting engagement rib 138 integral with the gasket member 129 in the narrow clearance 114 between the side edge 113 of the glazing element 104 and the bottom section 112 of the depression 111 in the second profile wall 109 of the window frame 107. The engagement rib 138 may as shown be formed with engaging projections 139 gripping around an internal glass layer of the glazing element 104.

The window component 101 may as shown be connected with the curb frame by means of screws 140 passing through screw holes 141, which for this type of installation may be formed in the second profile wall 109 of the window frame 107.

Thus, as demonstrated by FIGS. 1 to 4 the invention offers the advantage of using the same window component for deck-mounted roof window assemblies as well as curb-mounted installations.

Figure 5:
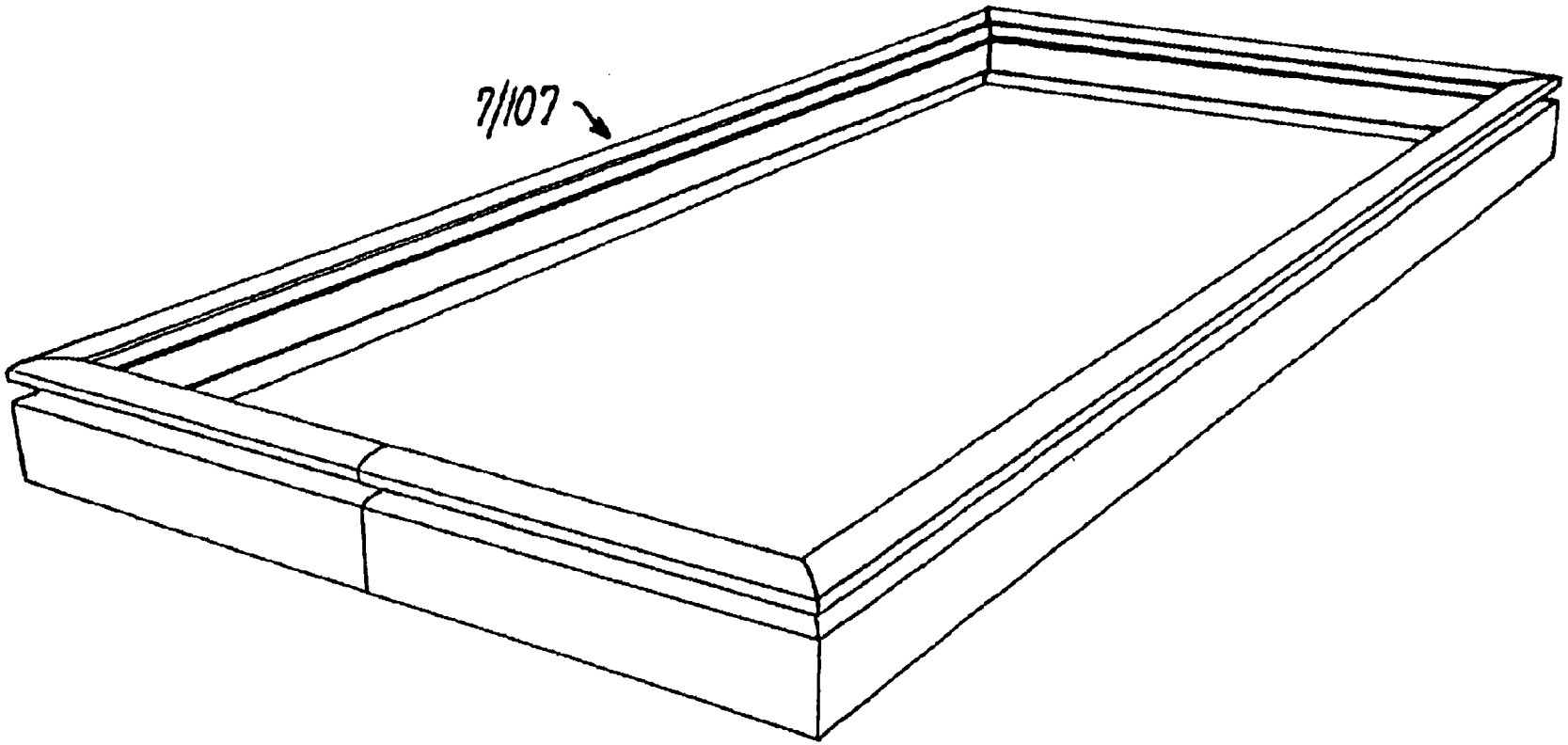
FIGS. 5 and 6 are perspective views of a preferred embodiment of a window component according to the invention.

As illustrated by the perspective view in FIG. 5, the profiling of the window frame 7 or 107, respectively, will provide for both types of installation an aesthetically appealing outer finish to the appearance of the window component and thereby to the window assembly or installation as a whole, of which the window component forms the most visible part.

Figure 6:
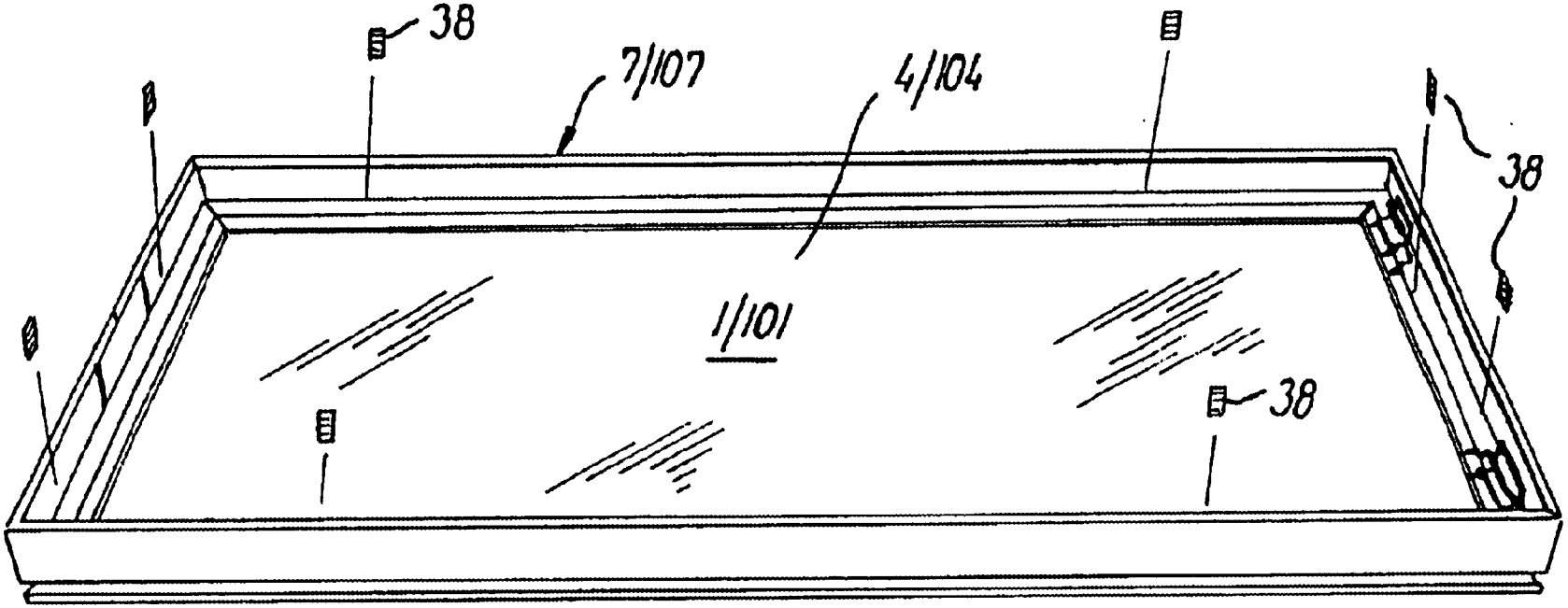

In the perspective view in FIG. 6, the window component 1 or 101 is shown from the other side to illustrate the positioning of the glazing element 4 or 104 with respect to the window frame 7 or 107. The connection of the glazing element 4 or 104 with the window frame 7 or 107 solely by means of the adhesive strip 17 interposed between the edge zones 5 or 105 at the external major surface 6 or 106 of the glazing element 4 or 104, whereby the adhesive strip will be positioned in a single plane parallel to the glazing element surface, provides for simplification of the production by enabling application of the adhesive strip by robotized propagation of an applicator tool in x-y directions parallel to the sides of the window frame.

In addition, the confinement of the adhesive strip 17 to a single plane leaves the side edge of the glazing element 4 uncovered by adhesive to allow introduction of the projecting rib 138 of the gasket member 129 with engaging projections 139 gripping around the inner glass layer of the glazing element.

Before positioning of the glazing element 4 or 104 in the window frame 7 or 107 spacer members 38 are arranged at all sides of the frame to provide a well defined width of the clearance 14 or 114 between the bottom section 12 of 112 of the depression 11 or 111 of the window frame 7 or 107.

Figure 7:
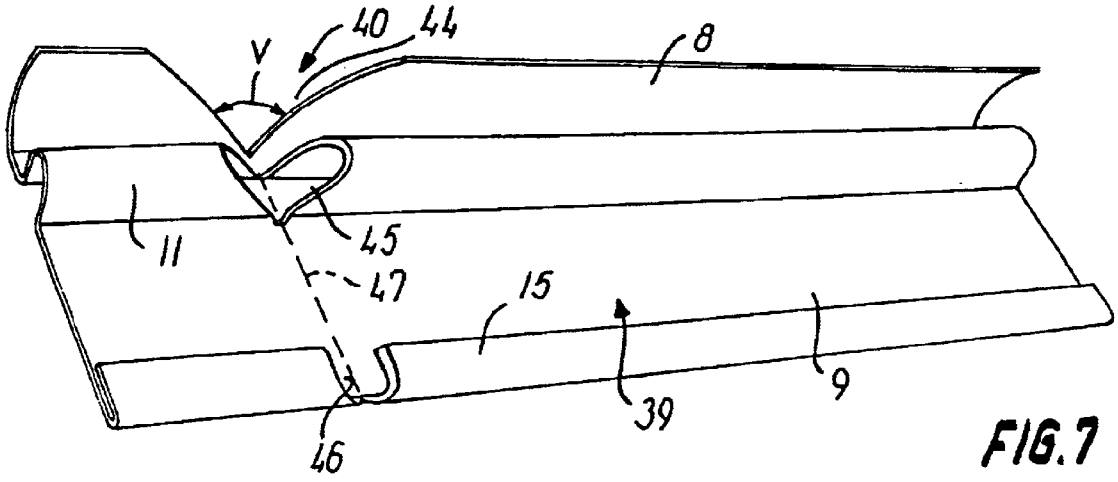
FIGS. 7 and 8 are perspective views illustrating a preferred method of production of a window frame for the window component in FIGS. 5 and 6.
Figure 8:
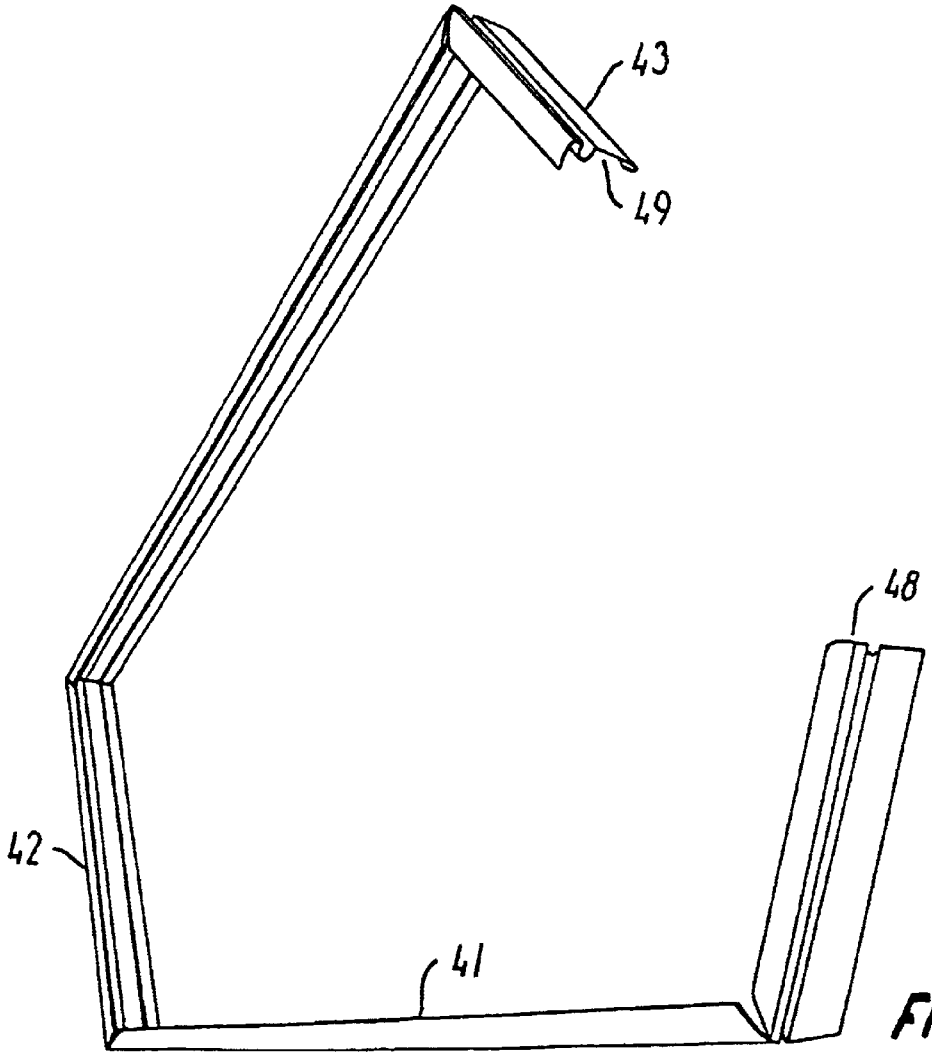

As illustrated in the perspective views in FIG. 7 and 8 the window frame 7 or 107 of the window component 1 or 101 shown in FIGS. 1 to 6 may be formed from a single continuous sheet metal profile 39, e.g. of roll-formed aluminum of a thickness of 1.5 mm. In such a continuous profile bending positions 40 may be provided, as shown for the profile section in FIG. 7, at discrete positions along the length of the profile, which is dimensioned to correspond to the total perimeter length of the window frame 7 or 107, to provide corner junctions between neighboring frame sides such as the lateral, top and bottom sides 41, 42 and 43, respectively, of a rectangular frame as shown in FIGS. 5 and 6.

For exact definition of each bending positions 40 substantially V-shaped cut-outs 44, 45, and 46 are formed in the first profile wall 8 and the depression 11 and the bent edge flange 15 of the second profile wall 9, each with its apex located on a common line 47 in the general plane of the second profile wall 9. In the illustrated embodiment the apex angle v of each of cut-outs 44 to 46 is 90°, but for other polygonal frame configurations than rectangular the apex angle will be determined by the target angle between the neighboring frame sides at either side of the corner junction, i.e. 180° minus the target angle. Thus, for window frames of regular pentagonal or hexagonal configuration the apex angle for each cut-out formed to define a bending position would be 72° or 60°, respectively.

Geometrically each of cut-outs 44 to 46 must be formed to be symmetrical with respect to a plane normal to the general plane of the second profile wall 9 along the common apex line 47.

Once the bending positions 39 have been defined by forming of the cut-outs 44 to 46 the frame is easily bent into the desired target frame configuration by application of a moderate force, which will not affect the preformed, e.g. roll-formed profile cross-section.

As shown in FIG. 8, the bending positions are located such that two bending positions will be positioned at substantially equal distances from the free ends 48 and 49 of the single continuous profile 38 used for the frame, such that a closing joint for the completed frame will be located at the center of one of the frame sides.

Figure 9:
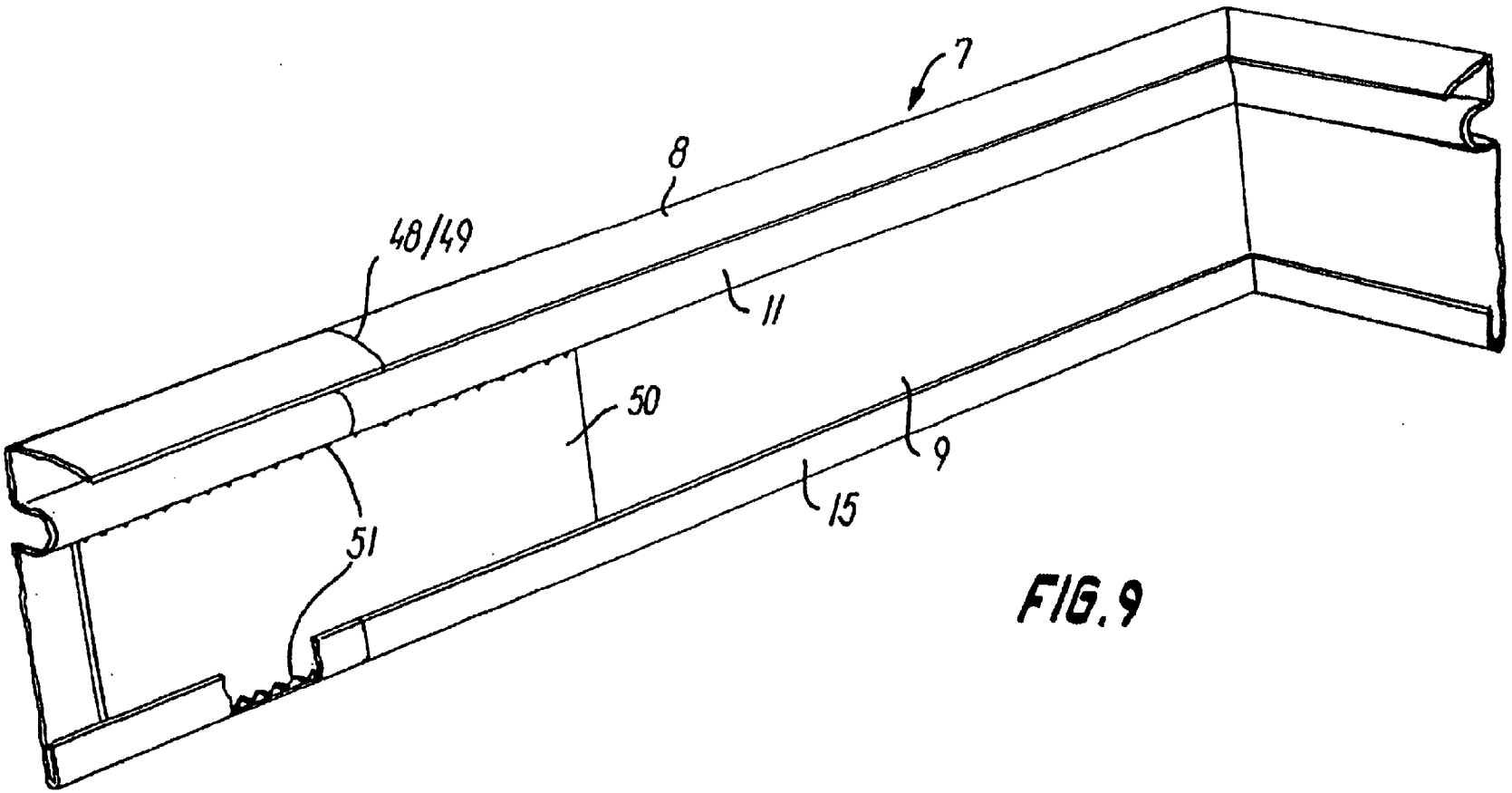
FIG. 9 is an enlarged perspective view of a section of the window component shown in FIGS. 7 and 8.

In the illustrated embodiment closing of the window frame at the adjoining free ends 48 and 49 may be provided as shown in FIG. 9 by means of a simple flat locking member 50, e.g. of steel plate, inserted at each of profile ends 48 and 49 into the track 16 provided by the bent edge flange 15 and having a width dimensioned to provide locking engagement with the bottom of the track 16, on one hand, and the underside of the depression 11, on the other hand. To provide optimum locking effect the longitudinal edges 51 of the locking member 50 may be profiled with relatively sharply pointed projections, e.g. in saw-tooth shape.

Other ways of closing the window frame may be contemplated, however, e.g. by a welded joint or an adhesive joint.

As shown in the sectional view in FIG. 2, the depression 11 formed in the second profile wall 9 of the window frame 7 may be used in the top side 42 of the frame to be connected with the top member 19 of the main frame component 2 for exact positioning of an elongate connecting member 52. This connecting member, which may made from steel profile, is formed in the illustrated embodiment with a substantially V-formed track 53 having a part-cylindrical bottom face 54 and projecting from a flat base flange 55, which is pressed by a forced TOX-ing operation into the second profile wall 9 of the window frame 7 to be secured thereto. At the upper side the base flange 55 of the connecting member 52 is formed with a curved bead 56 fitting the curvature of the corner joint between the profile wall 9 and the underside of the depression 11.

The V-shaped track 53 is defined by two projecting ribs 57 and 58 from the base flange 55, of which the upper rib 57 is formed on its upper side with a projection 59, which is engaged by a track 60 formed in an angled positioning guide member 61, which is thereby positioned to have angular projections 62 and 63 located in the clearance between the projecting rib 57 of the connecting member 52 and the underside of the depression 11 and between the bottom section 12 of the depression 11 and the inner glass layer of the insulating glazing element 4. In addition the guide member 61 is formed with an inclined projecting lip 64 in sealing engagement against the internal major surface 10 of the glazing element 4.

In the illustrated embodiment of a roof window assembly the elongate connecting member 52 thus secured to the top side 42 of the window frame is used, in both fixed and ventilating window versions to provide connection with the top member 19 of the main frame component 2 by engagement with a mating connecting member, which is secured to the external side of the main frame top member 19 and will be further described in the following.

As further shown in FIG. 2, the track 16 formed by the bent edge flange 15 at the top member of the window frame 7 may used to retain an engagement rib 65 of gasket member 66 formed with a sealing lip for sealing against a flashing member, such as the top member 35 of the flashing frame 33 of the flashing component 3, on the external side of the main frame top member 19 to provide water protection to the upper external side of the window assembly.

As shown in the sectional view in FIG. 3 and further explained in the following the bent end flange 15 at the lower end of the second profile wall 9 of the window frame 7 is used at the bottom side 43 of the frame to be connected with the bottom member 20 of the main frame component 2 to engage with a locking member secured to the main frame bottom member 20 to provide a locking connection of the window component 1 with the main frame component 2 in fixed, non-ventilating window versions.

In the production flow, the window component 1 may, for use in a roof window assembly as shown in FIGS. 1 to 3, be completed with the connecting member 52, the positioning guide member 61 and the gasket member 66, whereby a window component is prepared, which is ready made for connection with the main frame component 2.

Figure 10:
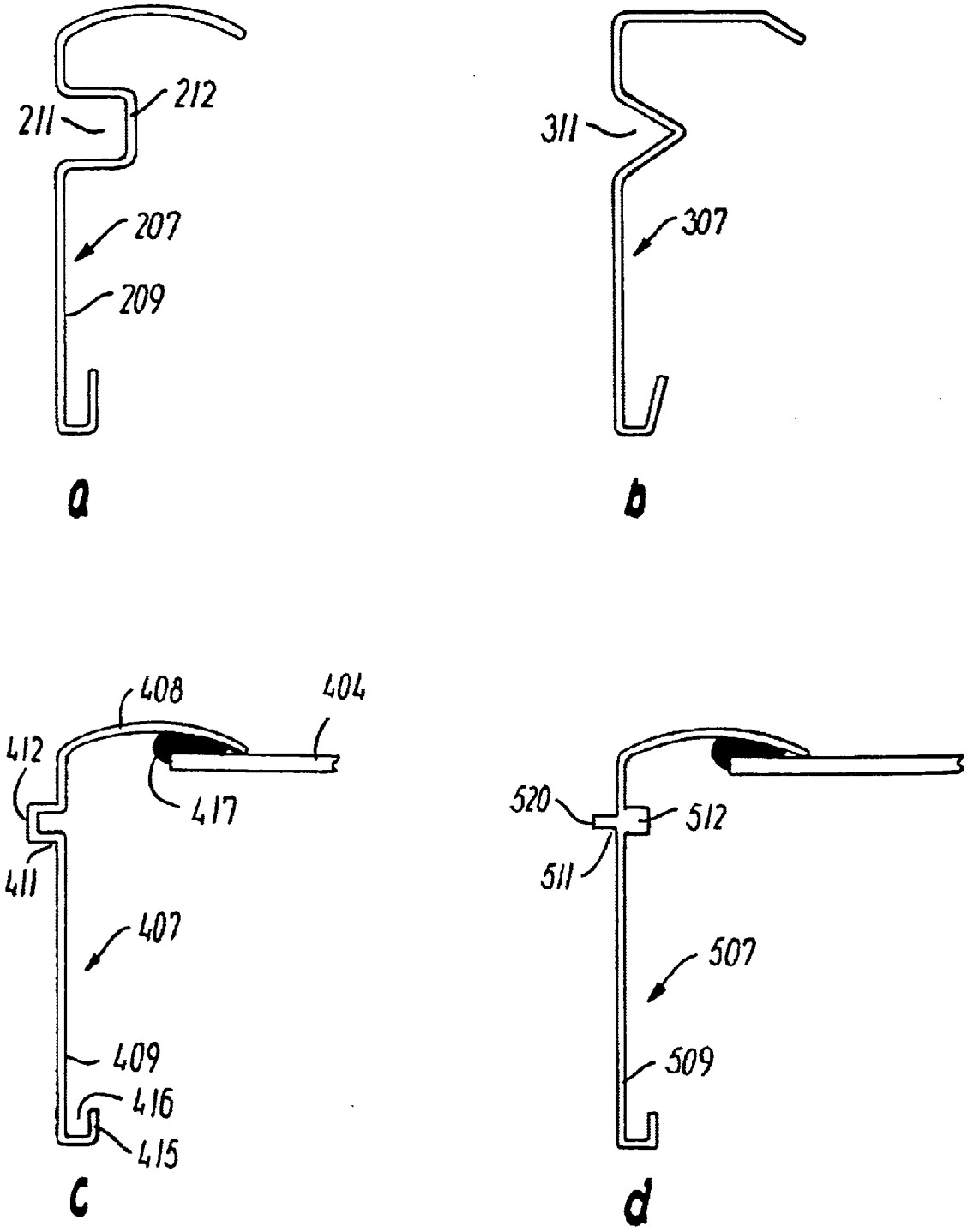
FIG. 10 shows schematic sectional views of alternative profile shapes of the window frame shown in FIGS. 1 to 6.

In the sectional views at a) to d) in FIG. 10 alternative profile forms of the window frame 207 to 507, respectively, for use in the window component are shown. In FIG. 10*a*) the depression 212 providing the recess 211 in the second profile wall 209 is generally U shaped as in the embodiment shown in FIGS. 1 to 9, but is formed with a substantially flat bottom section 212*a* in stead of the substantially part-cylindrical bottom section 12*a* of the depression 12 shown in FIGS. 1 to 4, whereas in FIG. 10*b*) the depression 312 providing the recess 311 is formed to be substantially V-shaped.

In the frame 407 shown in FIG. 10*c*) the recess 411 is formed by a wall part 412 projecting outwardly from the second profile wall 409. A glazing element 404 comprising a single glass layer only is secured to the frame 407 by an adhesive strip joint 417 at the first profile wall 408. By the provision of the recess 411 in this way it will not be possible to produce the frame from a single continuous profile as illustrated in FIGS. 7 to 9, but the frame can easily be made up of separate frame members connected in a conventional way to form the rectangular frame. Further, in this embodiment an elongate connecting member like the member 52 shown in FIGS. 1 to 3 may positioned against and secured to the inner side of the second profile wall 409 by being engaged in the track 416 formed by the bent edge flange 415.

As illustrated in FIG. 10*d*) the window frame 507 may alternatively be made from extruded profile members, e.g. of aluminum. In this case the recess 511 may be formed by a rib 520 projecting from the external side of the second profile wall 509. On the inner side of the second profile wall 509 a projection rib part 512 may be formed to serve the same purpose as the inwards projecting depression 12 in FIGS. 1 to 4 with respect to positioning of an elongate connecting member as well as a positioning guide member as shown in FIG. 2.

Figure 11:
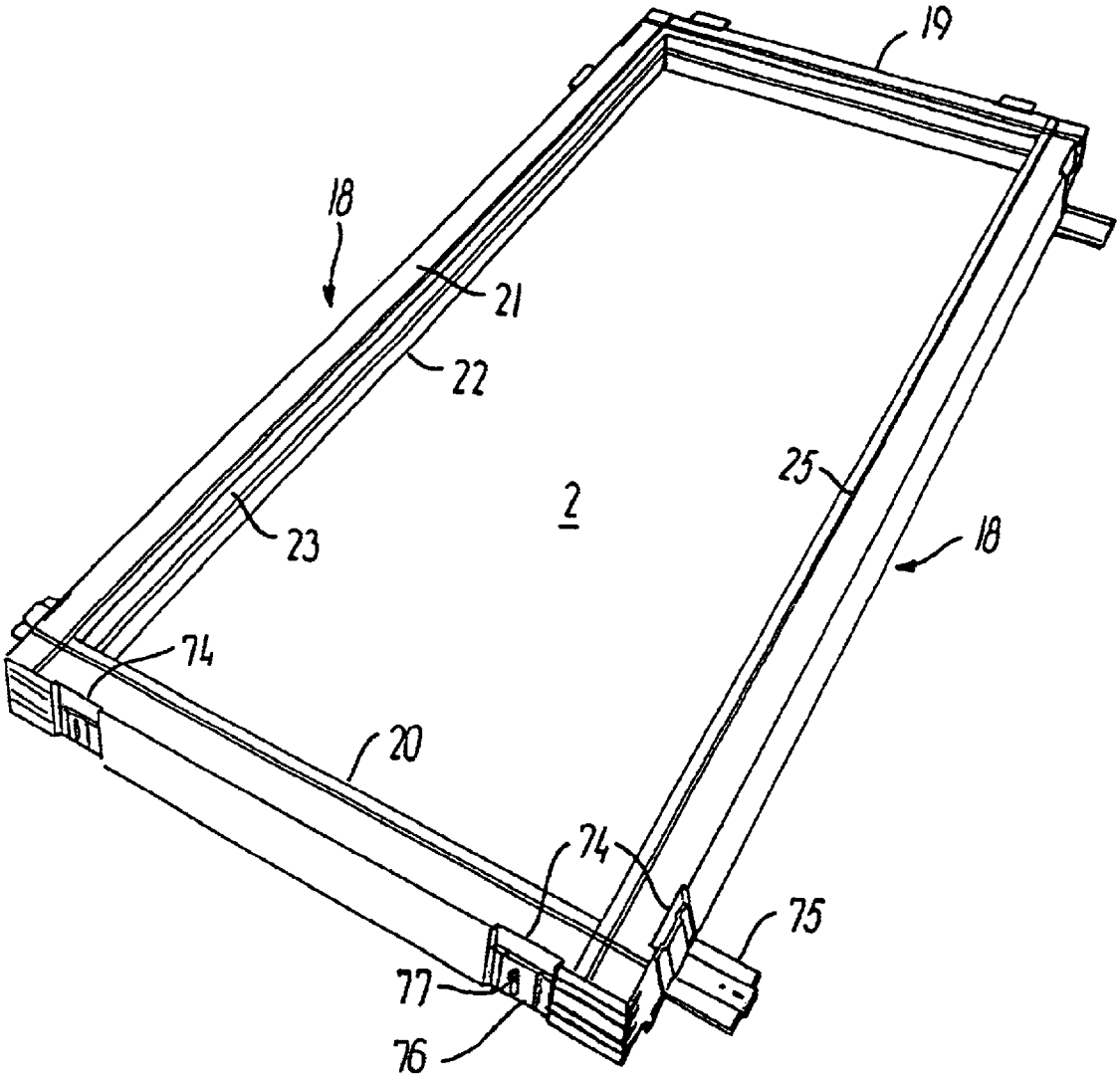
FIGS. 11 and 12 are perspective views of a main frame component and top, side and bottom members thereof.
Figure 12:
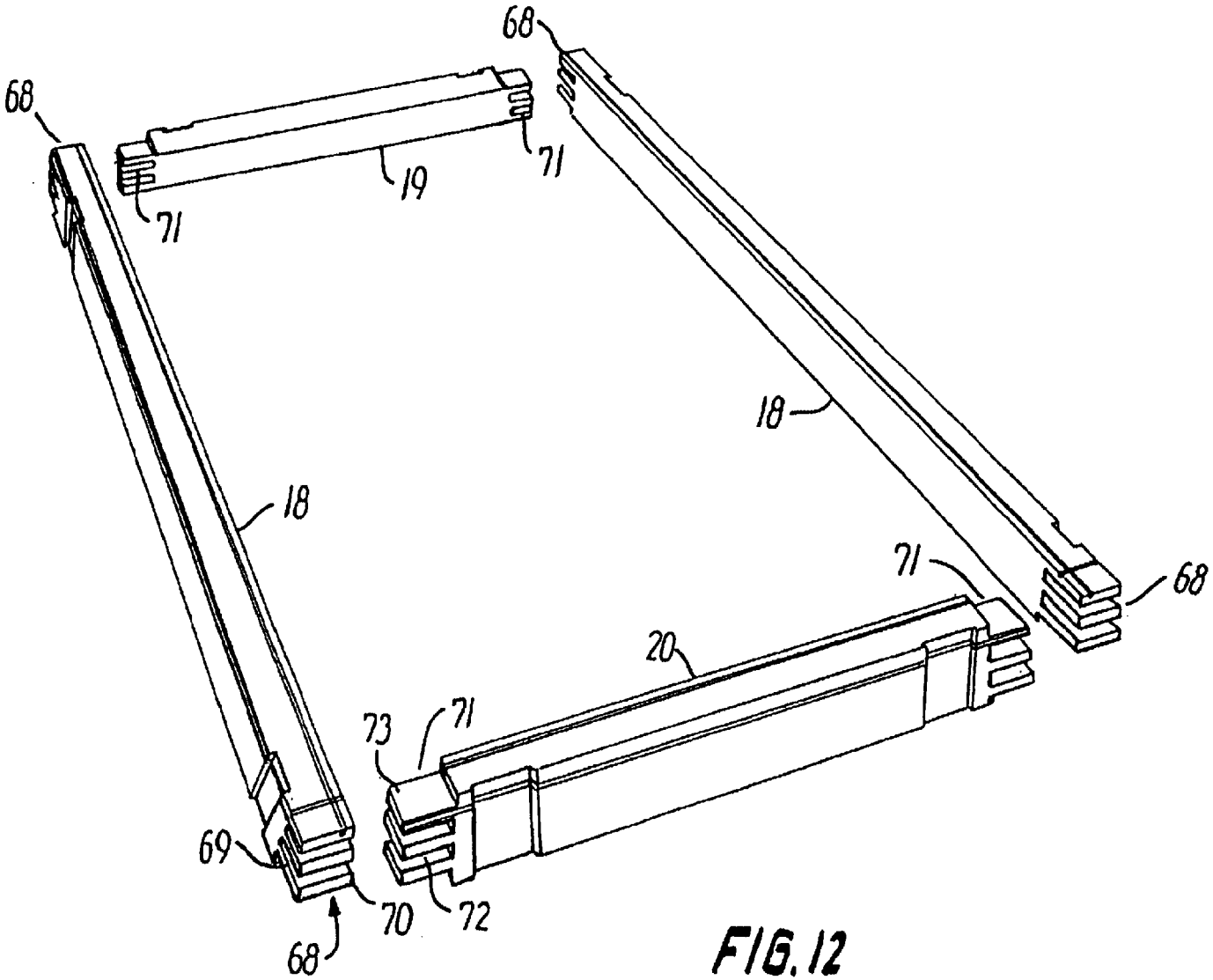

FIGS. 11 and 12 are perspective views, respectively, of a complete main frame component 2 as used in the sectional views in FIGS. 1 to 3 and of the individual side, top and bottom members thereof retracted from each other in an exploded representation.

As illustrated the main frame component 2 is composed in the rectangular configuration of two side members 18, a top member 19 and a bottom member 20 made of wood profiles formed and joined in such a way that in the completed main frame component the upper side faces 21 of the side top and bottom profiles will generally define a common window plane as abutment for the internal major surface 10 of the window component.

In the version illustrated in FIGS. 11 and 12, which is intended for use in fixed, non-openable window assemblies, all of the side, top and bottom members 18 to 20 are formed with the same cross-sectional profile. As known per se from the above-mentioned WO publications 98/22682, 98/22685 and 98/22686 the cross sectional profiles may have the general form of a parallelogram, in which the lower side face 22 forms together with the upper side face 21 a first pair of substantially parallel sides, whereas a second pair of substantially parallel sides form the inner and outer side faces 23 and 24, respectively. The inclination of the parallelogram cross-section may be varied as desired within a specified range, e.g. as mentioned a range for the value of the minor included angle $\alpha$ from 40° to 85° as disclosed in the above-mentioned publications with a preferred minor included angle $\alpha$=79°.

As shown in FIG. 12 the side, top and bottom members 18 to 20 are connected by mortised corner joints 67, preferably formed in such a way that at either end of each of side members 18 a first configuration 68 of mortises 69 and tenors 70 is formed, whereas at either end of each of the top member 19 and the bottom member 20 a second configuration 71 of mortises 72 and tenors 73 is formed to match the first configuration 68 in such a way as to have a common window plane defined by the upper side faces 21 of main frame members 18 to 20. Thereby a significant simplification of the production suitable for robotized operation can be obtained together with the advantage that the two side members 18 and, in the illustrated version, also the top and bottom members will be identical in pairs and interchangeable.

As will appear most clearly from the sectional views in FIGS. 1 to 3, the side, top and bottom members 18 to 20 are formed in their side faces 21 to 24 with various tracks, grooves and depressions.

Thus, in the illustrated version for fixed window assemblies the longitudinal track 25 is formed in each of the upper side faces 21 for retainment of the projecting rib part 28 of the gasket member 29 interposed at the common window plane between the upper side face 21 and the internal major surface 10 of the insulating glazing element 4 of the window component 1.

In each of outer side faces 24 two transverse groove-like depressions 74 of equal shape are formed to be located at equal distances from either end of the respective member relatively close to the respective end. These depressions are used for securing various mounting, connecting and positioning members to the main frame component 2.

Thus, as seen in FIG. 11 the depressions 74 formed in the outer side faces 24 of the side members 18 accommodate two pairs of angular mounting brackets 75, which may generally be of a form known per se, for securing the window assembly to supporting means such as rafters of a roof structure.

As seen in FIGS. 1 to 3, each of the outer side faces 24 of the side and top members 18 and 19 is also formed with the longitudinal track 27, which for the outer side of the side members 18 is used to secure accurate positioning of the mounting brackets 75 by engagement with a projecting engagement rib (not shown) on the rear side of the part of the angular mounting bracket 75 arranged in the depression 74.

As shown in FIG. 3, the depressions 74 formed in the outer side face 24 of the bottom member 20 are used according to a particular advantageous feature of the invention for arrangement of temporary positioning members 76 used only during installation of the window assembly to secure accurate positioning of the main frame component 2 with respect to a window opening formed in a roof structure, prior to final securing of the window assembly by firm connection of the mounting brackets 75 with the supporting means of the roof structure.

As shown in FIG. 11 the temporary positioning members 76 are formed with an elongate hole or slit 77, through which they are connected with the bottom member 20 to be displaceable in their respective depressions 74 to the lower holding position illustrated in FIG. 3. in which the positioning members 76 project below the lower side face 22 of the bottom member 20 to engage with an upper side of a transverse member of the roof structure forming the lower boundary of the window opening and hold the window assembly in the position thus defined, until the window assembly is finally secured to the roof structure by means of the mounting brackets 75.

Figure 13:
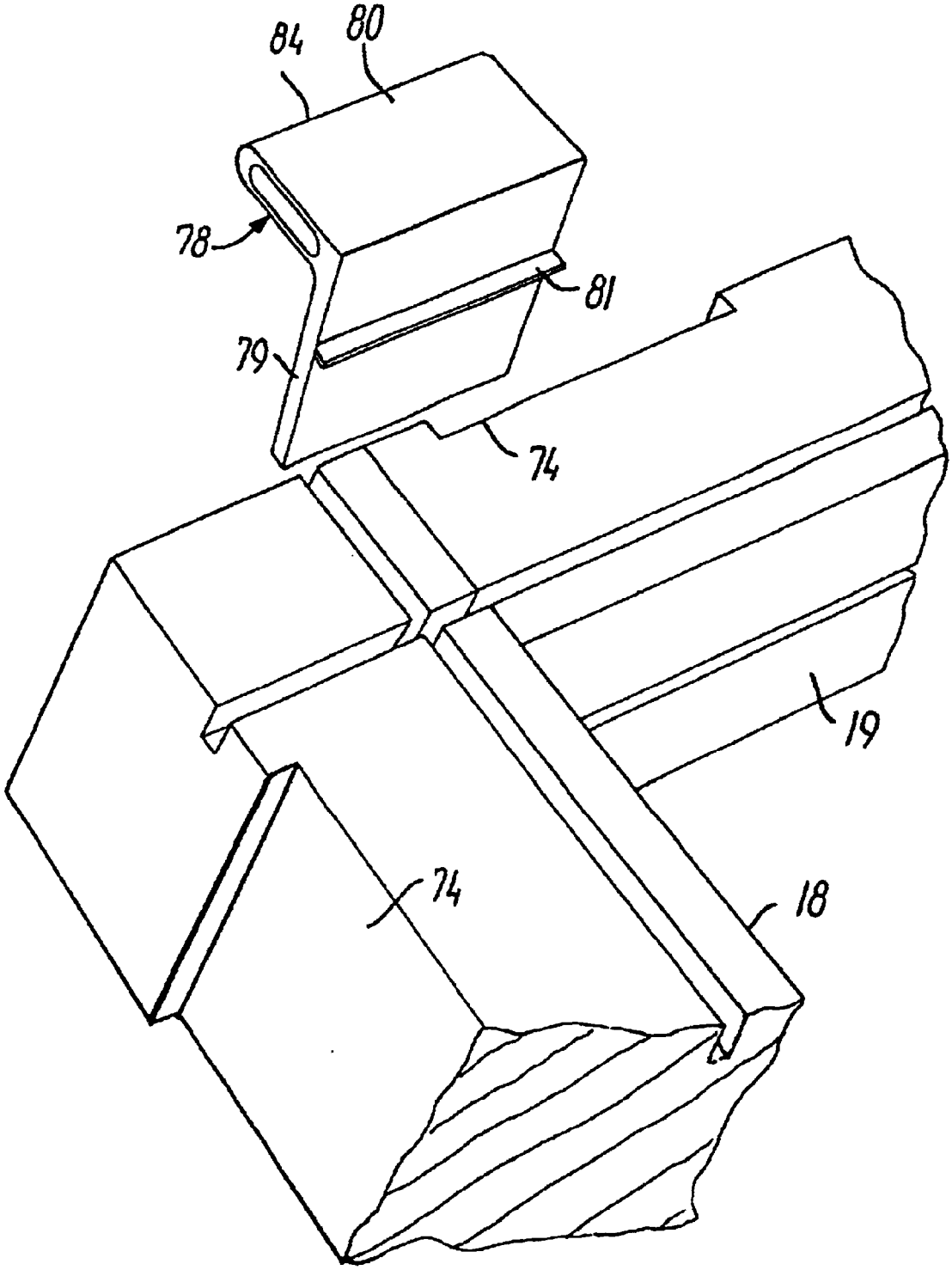
FIGS. 13 to 15 are perspective views of a connecting member for connection of a top member of the main frame component with a window component as shown in FIGS. 5 and 6.
Figure 14:
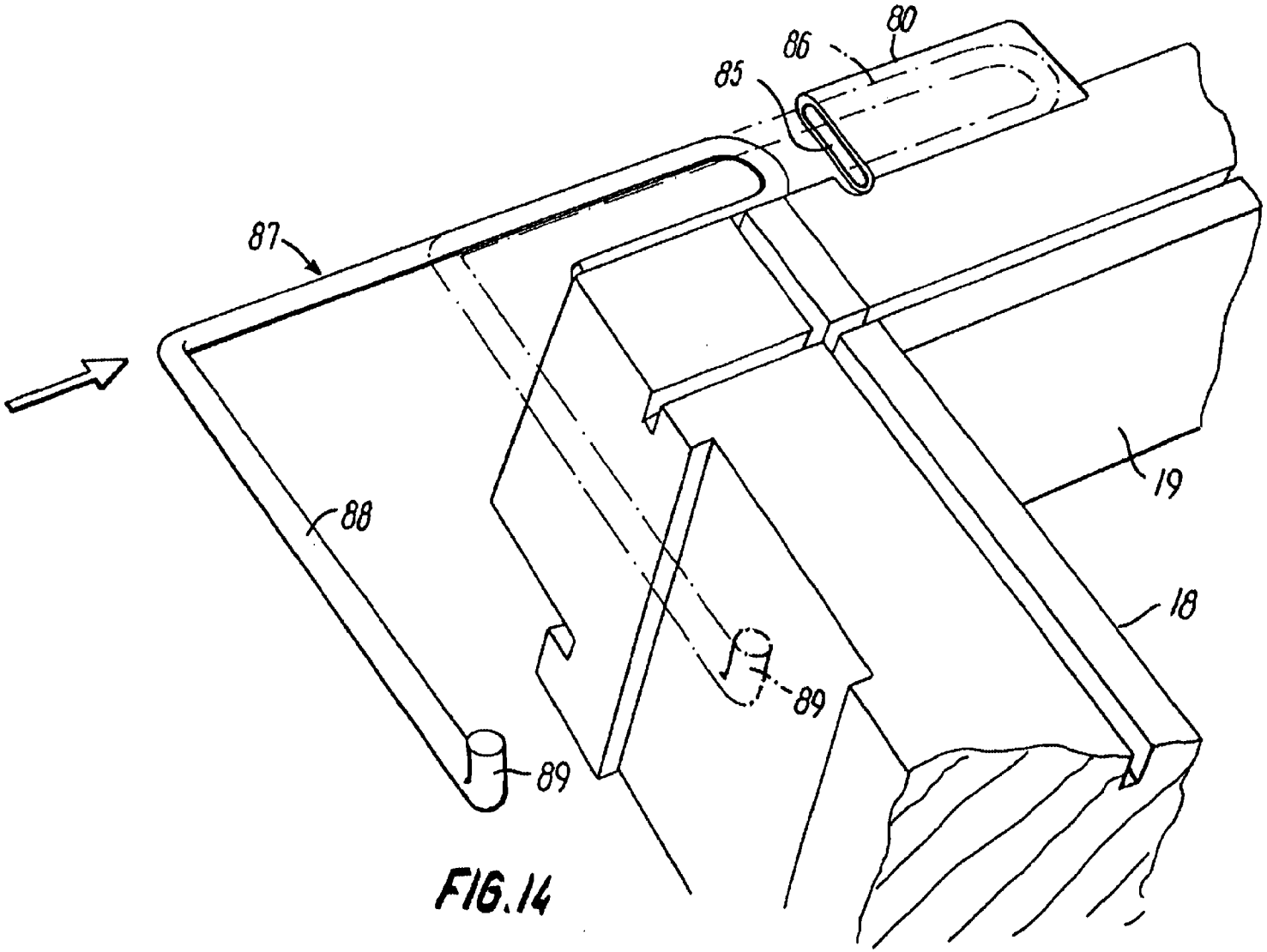

At the top member 19 of the main frame component 2 each of the depressions 74 in the outer side face 24 is used for securing of a generally angular connecting member 78 as illustrated in FIG. 13. Each connecting member 78 comprises a flange part 79 for positioning in and securing to a depression 74 as formed in the outer side face 24 and a projecting elongate engagement part 80 for engagement within the V-shaped track 53 formed by the elongate connecting member 52 secured to the second profile wall 9 of the window frame 7 of the window component 1 as illustrated in FIG. 2.

The flange part 79 of the connecting member 78 is formed with a narrow U-shaped cross-section forming a rear wall with a projecting engagement rib 81 for engagement with the longitudinal groove 27 in the outer side face 24 of the top member 19.

The pair of connecting members 52 and 78 used at top side of the window assembly for connection of the window component 1 with the top member 19 of the main frame component 2 are used both in the fixed non-openable version of the window assembly and a ventilating version, in which the window component 1 may be opened with respect to the main frame component 2.

For the fixed version safe engagement between the connecting members 52 and 78 at the top side is secured as shown in FIG. 2 by engagement of the bent edge flange 15 formed by the second profile wall 11 of the window frame 7 with a pair of resilient clip-like locking members 82 secured to the outer side face 24 of the bottom member 20 of the main frame component 2 as shown in FIG. 3.

In order to accomplish reliable and well-defined operation of the ventilating version, the pair of connecting members 52 and 78 at the top side is formed to provide a hinge joint with a well defined pivot axis, about which the window component 1 may be turned with respect to the main frame component 2. The pivot axis 83 is defined by forming the V-shaped track 53 in the connecting member 52 secured to the window component 1 and the engagement part 80 of the connecting member 78 secured to the top member 19 of the main frame component 2 with the substantially part-cylindrical engagement surfaces 54 and 84, respectively.

In order to limit the range of ventilating positions, to which the window component 1 may be turned with respect to the main frame component 2 the V-shaped track 53 in the connecting member 52 may be formed with a relatively narrow included angle β, preferably e.g. in the range from 20° to 30°. In the illustrated embodiment the included angle β is 22°.

Figure 15:
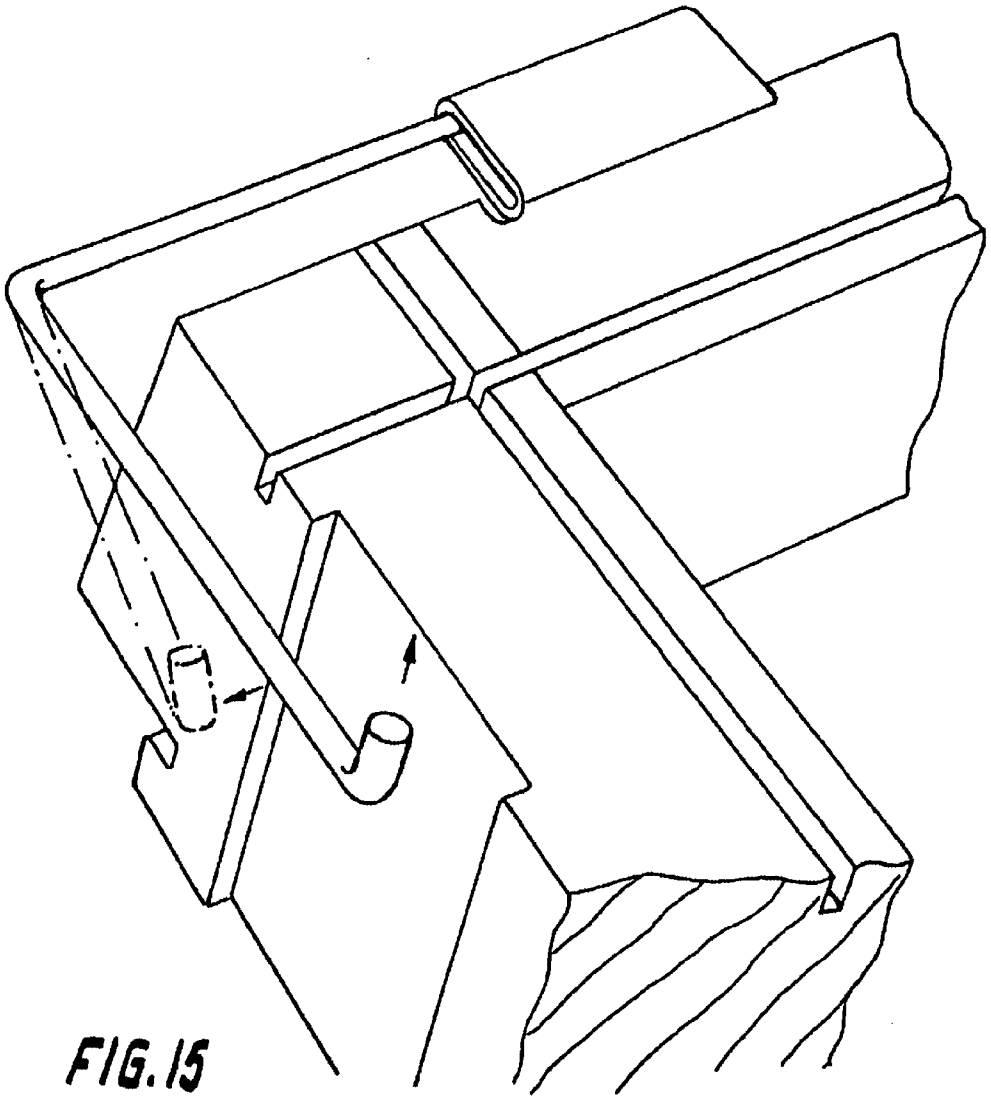

In the ventilating version, where no locking of the window component 1 with respect to the main frame component 2 is provided at the bottom side of the window assembly, the engagement between the connecting members 52 and 78 at each of the two hinge joints provided by the two pairs of connecting members is secured as shown in the enlarged perspective view in FIG. 15 by forming the engagement part 80 of the connecting member 78 with a longitudinal channel 85 receiving a retaining part 86 forming one leg of a generally angular torsion spring 87, another leg 88 of which extends between the upper part of the outer side face 24 of the side member 18 of the main frame component 2 and the second profile wall 9 of the window component 1 with a free end forming a hook member 89, which is loosely engaged as shown in FIG. 2 in a hole in a retainer block 90 secured to the second profile wall 9 of the window frame 7 of the window component 1.

The pairs of connecting members 52 and 78 at the top side of the window assembly provide several significant advantages.

As a result of the use of the same form of connecting members for both fixed and ventilating versions of the window assembly the same window component can be used for both versions, which simplifies production flow, and a window assembly originally supplied as a fixed version may relatively easily be modified into a ventilating version and vice versa. Moreover, as result of the arrangement of the connecting members 52 and 78 between the outer side face 24 of the top member 19 of the main frame component 2 and the second profile wall 9 of the window component 1 the connecting members will be well-protected and not visible from the outside, whereby the external appearance of the window assembly will be the same for both fixed and ventilating versions.

The open engagement of the connecting member 52 with its V-shaped track 53 onto the engagement part 80 of the connecting member 78 provides for very easy and simple installation of the window component 1 on the main frame component 2, once the latter has been secured to the roof structure, since the window component 1 is simply hooked onto the main frame component 2. This operation is, moreover, facilitated by the provision of the positioning guide members 61 shown in FIG. 2, which also provides protection to the side edge of the insulating glazing element 4.

In addition, the open engagement of connecting members 52 and 78 will provide for relatively easy dismounting of the window component 1 with respect to the main frame component 2. For a fixed version of the window assembly, dismounting will require release of the locking engagement provided by the clip-like locking members 82 at the bottom side of the assembly, e.g. by means of a special tool designed for this purpose. For ventilating versions, the engagement of connecting members 52 and 78 may be released by turning of the window component beyond the opening range defined by the V-shaped track 53, whereby the hook member 89 of the torsion spring 87 will be released from its engagement with the retainer block 90 secured to the window component 1. For both versions, once the engagement between the connecting members 52 and 78 has been released the window component 1 can relatively easily be hooked-off from the main frame component 2.

The release of the hook member 89 from its engagement with the retainer block 90, when the window component 1 is turned beyond the range of ventilation positions results from the design and dimensioning of the torsion spring 87 with a spring bias such that, in the absence of physical load the leg 88 of the torsion spring will extend in a direction forming an angle with the plane defined by the generally U-shaped retaining part 86 corresponding to the included angle β of the V-shaped track 53 in the connecting member 52. Thereby, turning the window component 1 beyond the position thus defined will result in release of the hook member 89 from the retainer block 90.

As further illustrated in the perspective view in FIG. 15 the spring bias of the torsion spring 87 is dimensioned such that, in the absence of physical load, the leg 88 will form an angle δ with the retaining part 86, which is slightly bigger than 90°. In result, by turning the window component 1 beyond the range of ventilating positions the leg 88 will project outwards below the edge flange 15 of the second profile wall 9 at the upper part of the sides of the window frame 7. In view of the fat that the engagement between connecting members 52 and 78 at either end of the top member 19 of the main frame component 2 is open-ended the torsion spring 87 provides a useful guide means assisting to secure accurate positioning of the window component 1 with respect to the main frame component 2, when the window component is turned back into a position within the ventilating range after having turned to a position beyond the ventilating range.

Figure 16:
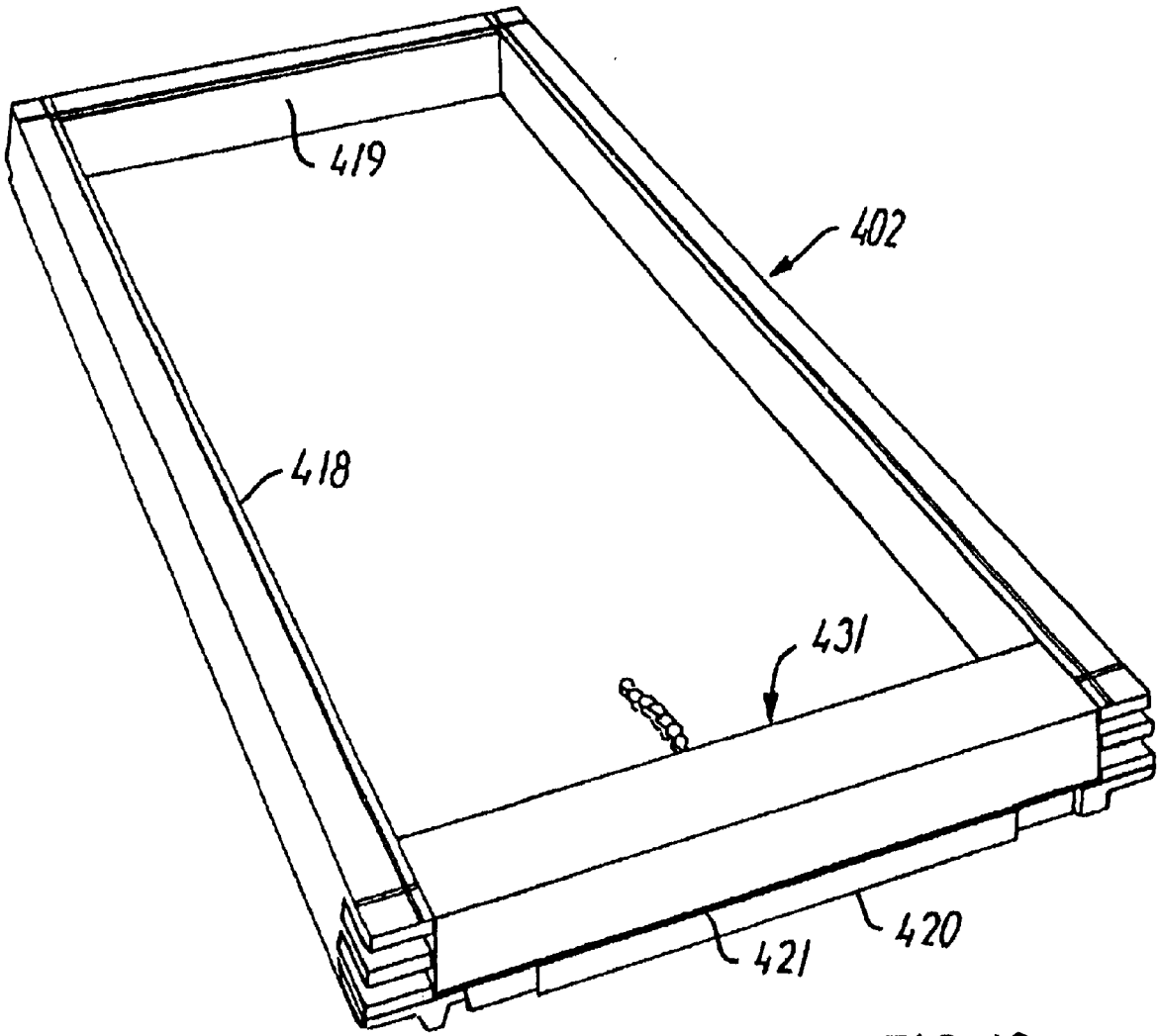
FIG. 16 is a perspective view of a modification of the main frame component shown in FIG. 12.

As illustrated in the perspective view in FIG. 16 electrical operation of the window component 1 in the ventilating version of the window assembly may be provided for by use of a slightly modified main frame component 402 having a bottom member 420, the upper side face 421 of which is retracted from the common window plane defined by the upper side faces of the side and top members 418 and 419 of the main frame component to leave a space between the common window plane and the upper side face 421 of the bottom member 420 for arrangement of a housing 431 of an electric window operator of a type known per se, e.g. a chain operator having an elongate opening member in form of a chain 432 with an end part 433 for connection with the side of the window component (not shown) opposite the bottom member 420. Such an electrical window operator may be adjusted to operate the window component between its closed position with respect to main frame component and any ventilating position within the range of positions defined by the hinge joints formed the pairs of connecting members 52 and 78 at the top side of the window assembly. To provide for dismounting of the window component the end part 433 of the operator chain 432 may be releasably connected with the window component in a manner known per se.

As further illustrated in FIGS. 1 to 3, the main frame component 2 of the window assembly of the invention will be covered on the outer side faces by flashing members serving to protect the wood profiles of the side, top and bottom members 18 to 20 of the main frame component and provide a safe watertight joint with the roof covering surrounding the window assembly.

Such flashing members are well known in the art and may be supplied in a multiplicity of different forms. For a window assembly according to the invention a flashing arrangement of an elastically deformable material as disclosed in published International Patent Application WO 94/00655 may thus be suitable.

Figure 17:
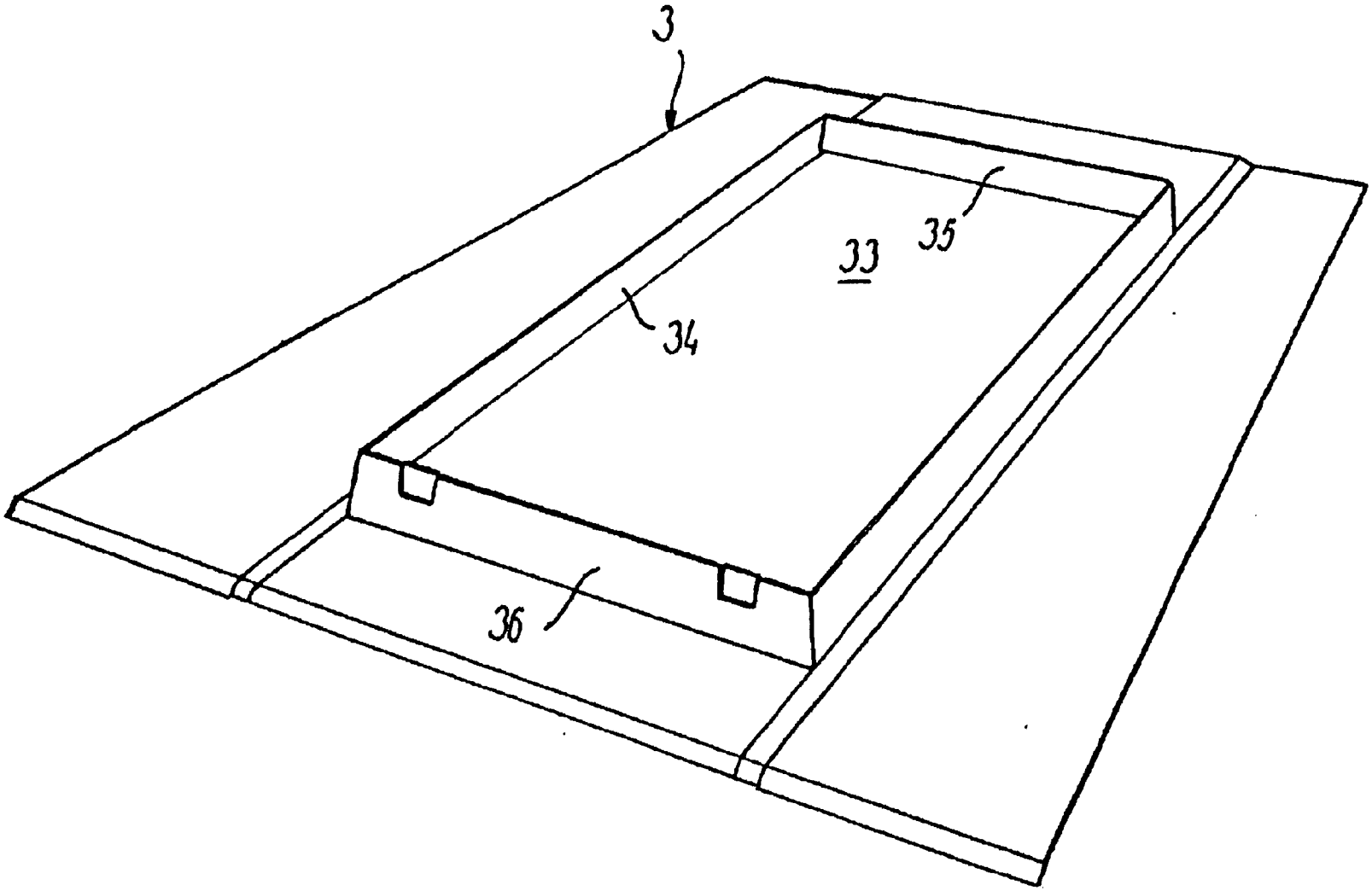
FIG. 17 is a perspective view of a flashing component as used in the roof window assembly shown in FIGS. 1 to 3.

As a special feature of the invention the window assembly may also be designed, however, in a self-flashing version by use of the integrated flashing component 38 as shown in the perspective view in FIG. 17.

In the illustrated embodiment the flashing component 3 comprises the rectangular flashing frame 33 of a substantially rigid material, e.g. sheet metal such as aluminum in a thickness of 1.5 mm, composed of side, top and bottom members 34 to 36 tailored to the outer side faces 24 of the side, top and bottom members 18 to 20 of the main frame component 2 and interconnected by welding such as laser welding or any other suitable connection method. As best seen in FIG. 1 the side members 34 to 36 of the flashing frame 33 are generally L-shaped with a part 91 engaging the outer side face 24 of the side member 18 of the main frame component 2 and a part 92 resting on the roof covering 93 immediately surrounding the window assembly and lying under the side flashing sheet 37, which is made of a resiliently foldable material, e.g. an elastomeric material.

As a result of the combination of the substantially rigid flashing frame 33 with the foldable resilient side flashing sheets 37 the flashing component 3 offers the advantageous integration of the flashing component 3 with the window and main frame components 1 and 2 of the window assembly into a single ready to use package including all components and parts needed for the installation of a safe and operational roof window.

Figure 18:
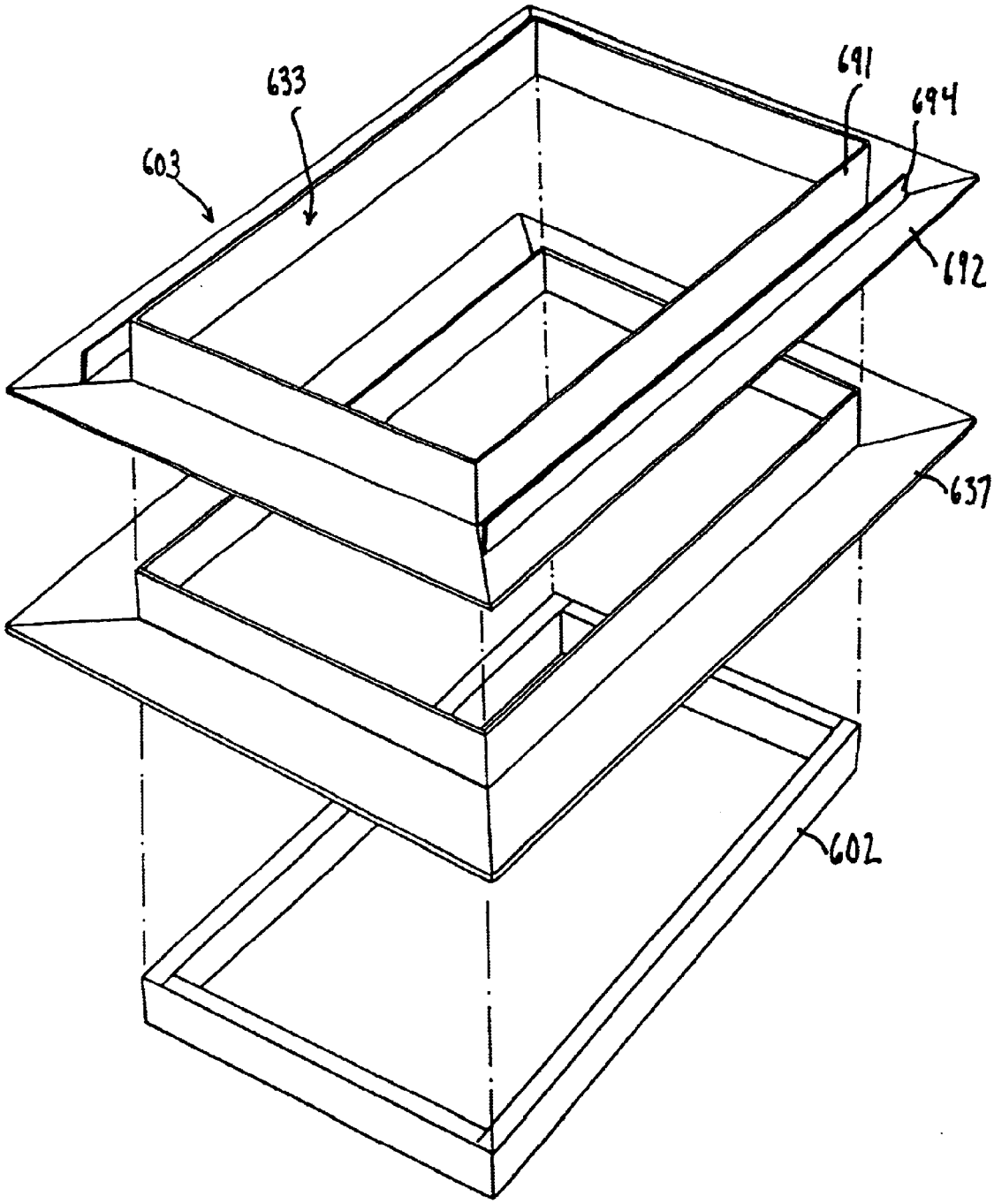
FIG. 18 is a perspective and exploded view of a preferred embodiment of a flashing component for the roof window assembly.

In the exploded perspective view in FIG. 18 another embodiment of a flashing component 603 is shown, which is composed of separate members in the form of a rigid FIG. 17, but with an increased width of the parts 692 intended to rest on the roof covering, and a collar member 637 of a resiliently deformable material, e.g. an elastomeric material, which in this case forms a sides of the side, top and bottom members of the main frame component 602 beneath the rigid flashing frame 633.

As illustrated, at the side members of the flashing frame 633 the parts 692 intended to rest on the roof covering are formed with an upwards projecting wall 694 extending parallel to the part 691 to positioned against the external sides of the main frame component 602 via the underlying collar member 637. These projecting walls at either side of the main frame component 602 serve to form water channels along each side of the window assembly, by which water flowing along the top member of the main frame component 602 will be effectively forced to flow downwards along the sides of the window assembly.

Figure 19:
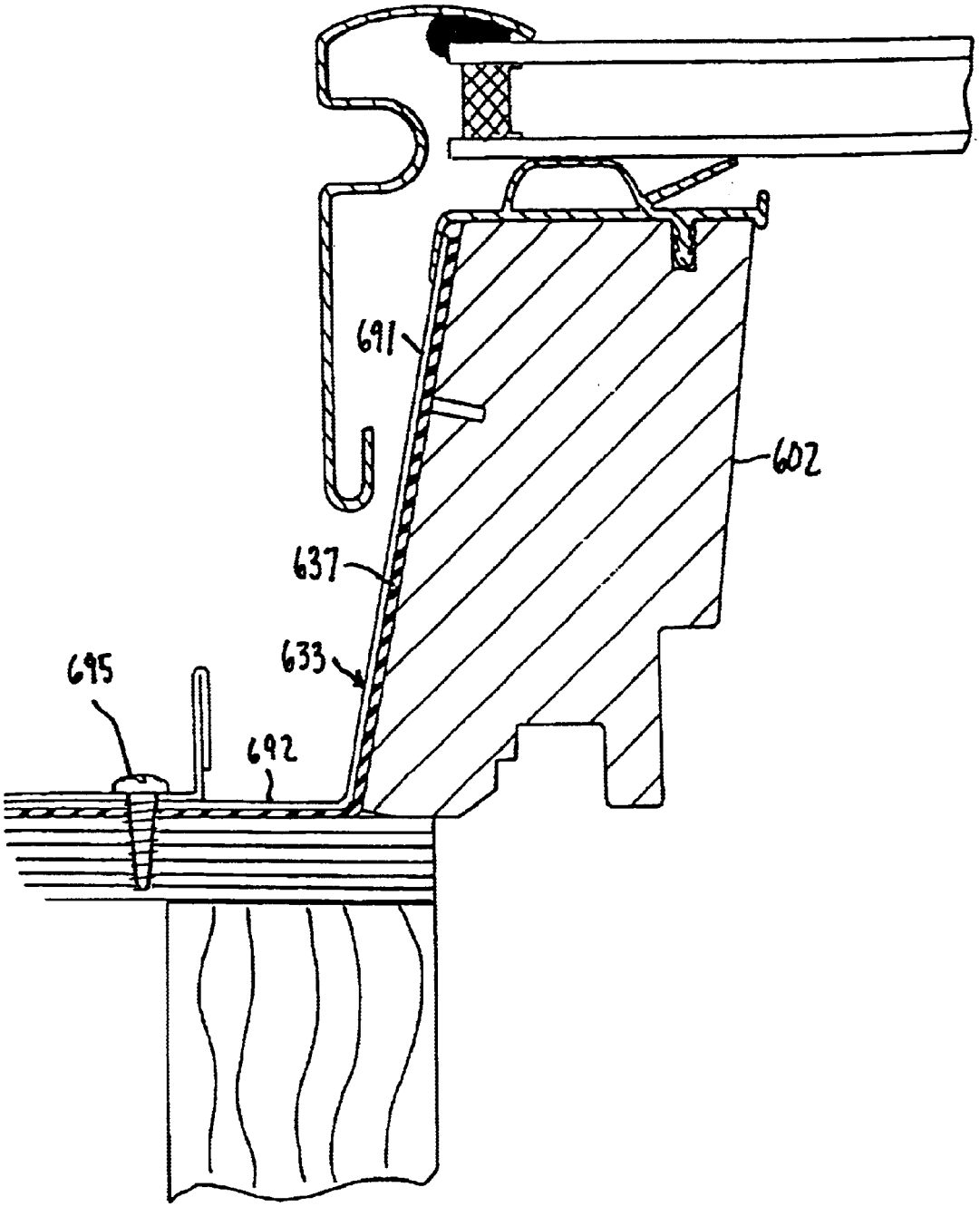
FIG. 19 is a sectional view of a modification of the roof window assembly in FIG. 1 with a flashing component as shown in FIG. 17.

As illustrated in the sectional view in FIG. 19 the design of the flashing component 603 in two separate parts with the foldable collar member 637 of resilient waterproof material underlying the rigid frame member 633 results in the advantage that the projecting side parts 692 of the rigid frame member 633 can be used for securing the entire window assembly with respect to the roof structure by means of nails 695, whereby the use of mounting brackets as illustrated in FIG. 11 can be dispensed with.

Figure 20:
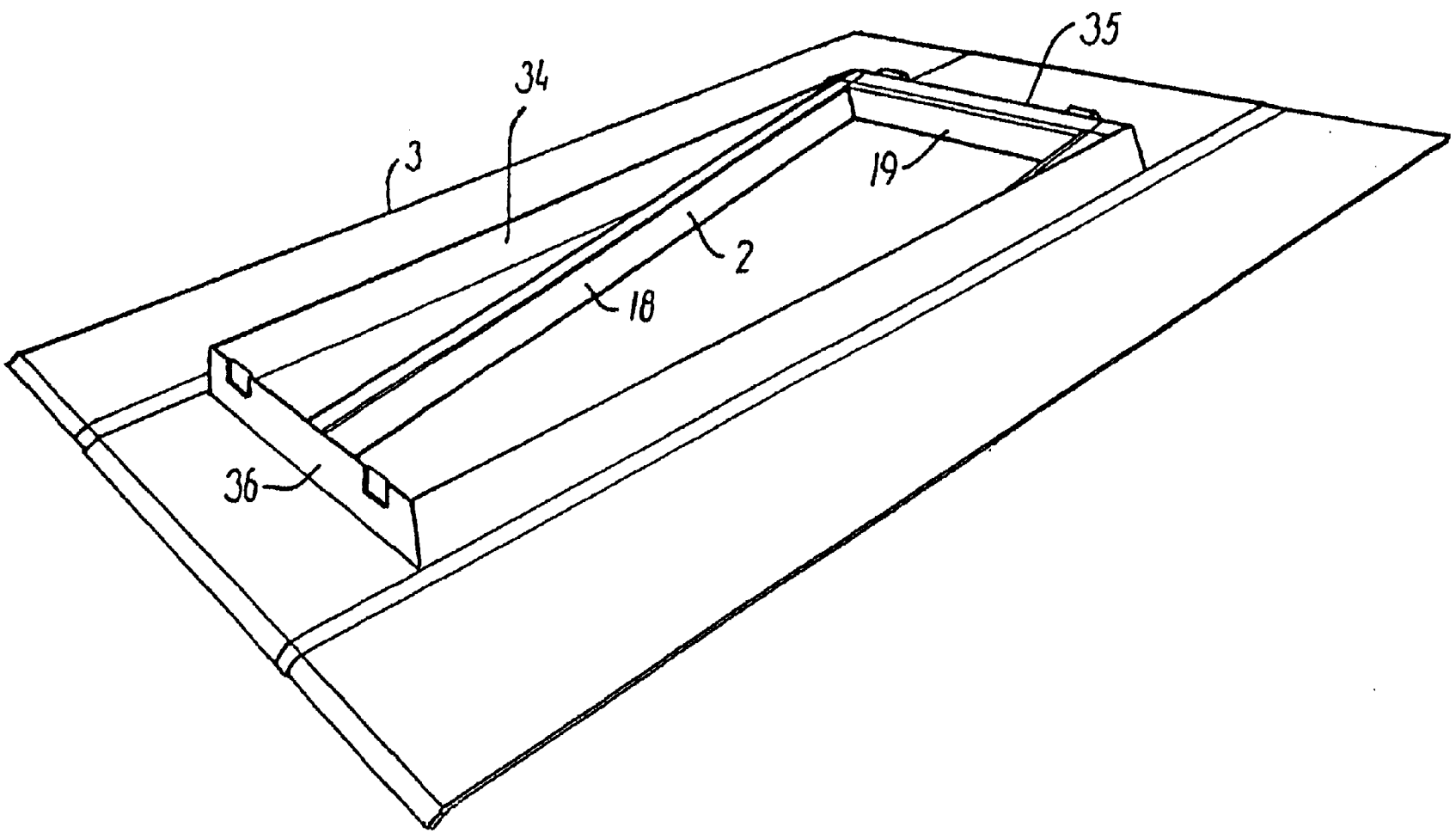
FIGS. 20 and 21 are perspective views of the assembling of the main frame, flashing and window components of a roof window assembly according to the invention.
Figure 21:
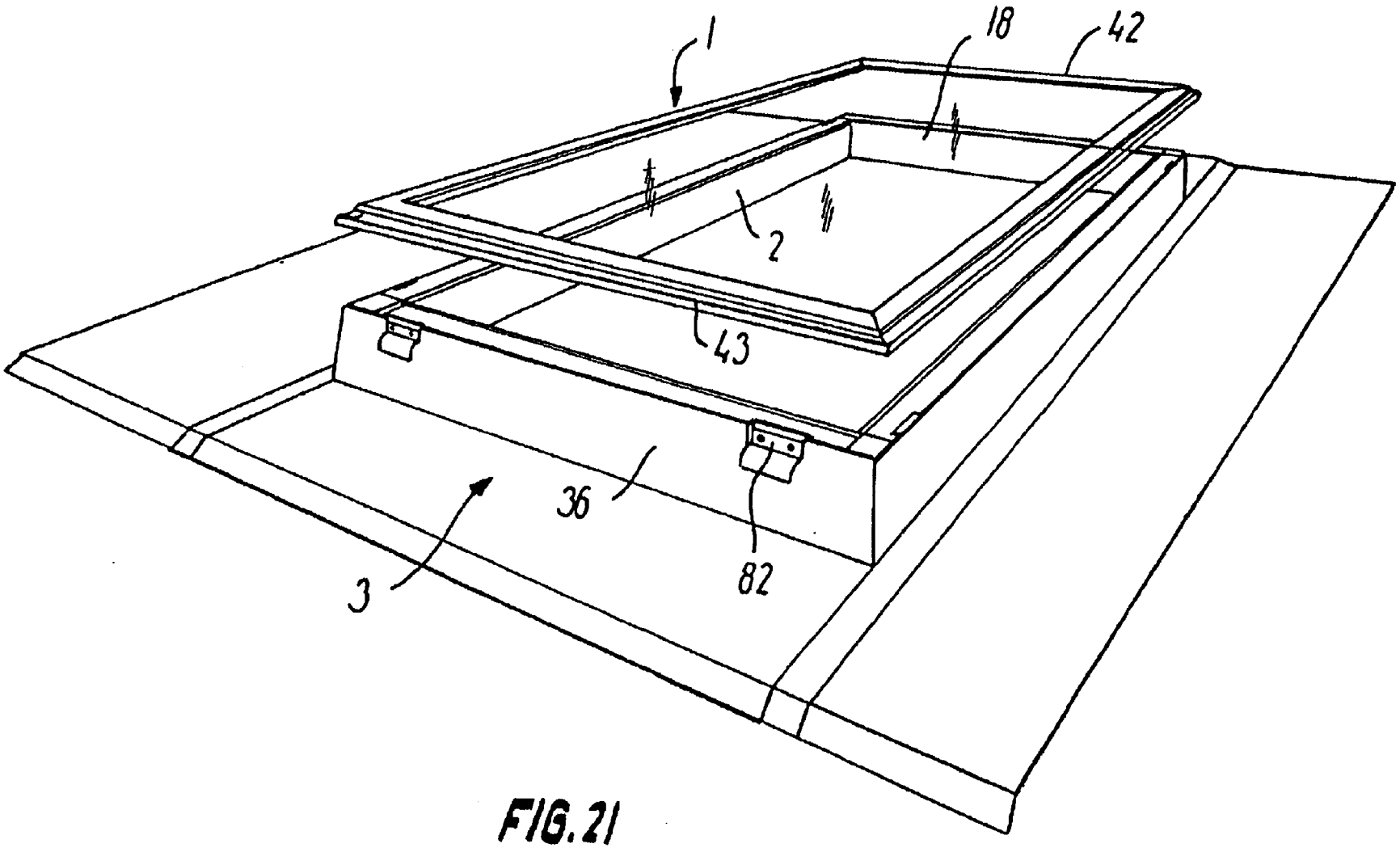

The comparatively easy installation of a roof window assembly according to the invention will become clear from the schematic perspective views in FIGS. 20 and 21. As shown in FIG. 20, installation of the window assembly in a window opening, which has been formed through the roof structure of an inclined roof starts with mounting of the main frame component 2, which in the manner described in the foregoing is secured to supporting means such as rafters of the roof structure by means of the angular mounting brackets 75 secured in the depressions 74 in outer side faces 24 of the side members 18.

Subsequently, after securing of connection members to the top and bottom members 19 and 20 of the main frame component 2 the flashing component 3 can be easily hooked onto the main frame component 2 by bringing the top member 35 of the flashing frame 33 into contact with the outer side face 24 of the top member 19 of the main frame component 2 and pushing the flashing frame 3 into place with its side and bottom members 34 and 36 arranged against the outer side faces 24 of the side and bottom members 18 and 20 of the main frame component 2.

As the last step in the installation procedure as illustrated in FIG. 21 the window component 1 is now hooked onto the main frame component 2 in the manner described in the foregoing by engaging the connecting members 52 secured to the top side 42 of the window component with the projecting engagement parts 80 of the connecting members 78 secured in the depressions 74 of the outer side face 24 of the top member 19 of the main framer component.

If a fixed version of the window assembly is to be installed the window component is subsequently simply clicked into place with the bent edge flange 15 at the bottom side 43 of the window component 1 engaging the clip-like locking members 82 secured in advance to the outer side face 24 of the bottom member 20 of the main frame component 2 by means of screws 96 as shown in FIG. 3.

If a ventilating version is to be installed the torsion spring 87 must be connected with the connecting member 78 by insertion of its retaining part 86 into the longitudinal channel 85 formed in the engagement part 80 of the connecting member 78 and the retainer block 90 must be connected with the second profile wall 9 of the window frame 7 in an appropriate position in the upper part of each lateral side 41 of the window component 1. After the window component has been hooked onto the main frame component 2 in the manner described the hook end 89 of the torsion spring 87 is brought into engagement with the retainer block 90, and, if electrical operation of the window component is envisaged, the end member 433 of an elongate operator member such as a chain 432 is connected with the bottom side 43 of the window component 1.

Figure 22:
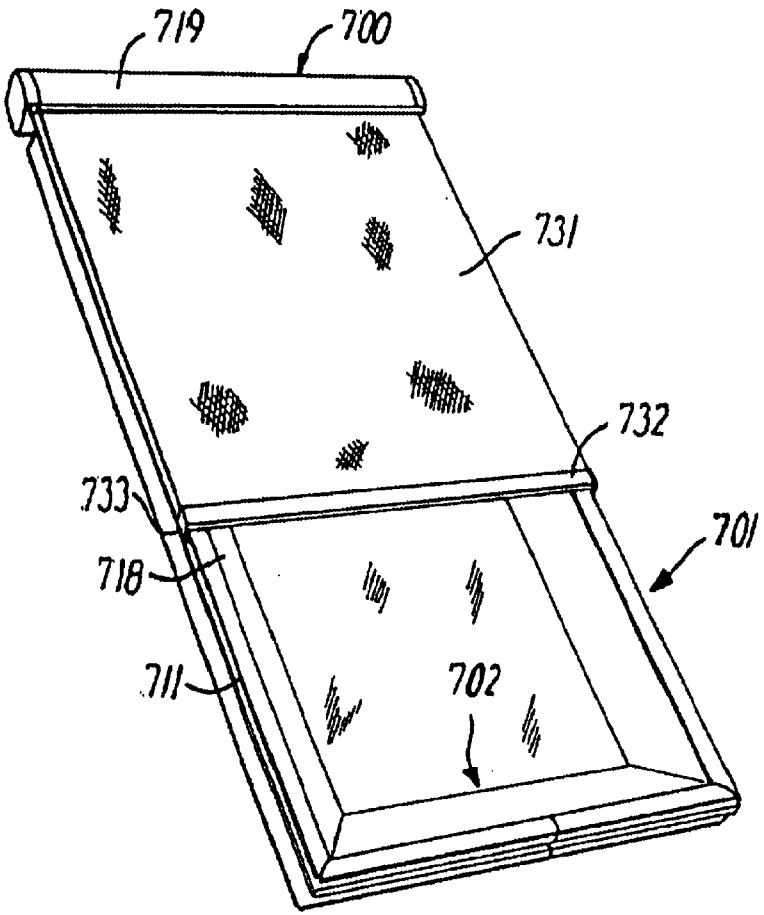
FIG. 22 is a perspective view of a roof window assembly according to the invention with an external screening accessory.

The recess 11 formed in the second profile wall 9 of the window frame 7 provides as shown in the perspective view in FIG. 22 an advantageous possibility for movement guiding and control of an external heat screening arrangement 700 of the kind comprising an elongate housing 719 extending along the top member of the window frame of the window component 701 and a screening member, e.g. in the form of a heat reflecting screening web 731 accommodated in rolled-up form in the housing 719 to be retractable therefrom by movement parallel to the side members 741 of the window frame.

A free end of the screening web 731 is connected with an end member 732, which extend throughout and somewhat beyond the width of the window component 701 between the lateral sides 741 thereof and is provided at either end with engaging means e.g. in the form of rollers 733 for engagement with and guiding in the depressions 711 from the external side of the window component 701.

Thus, the recess formed in the window frame of the window component 701 provides a window assembly, which is prepared for very easy installation of an external screening arrangement.

Figure 23:
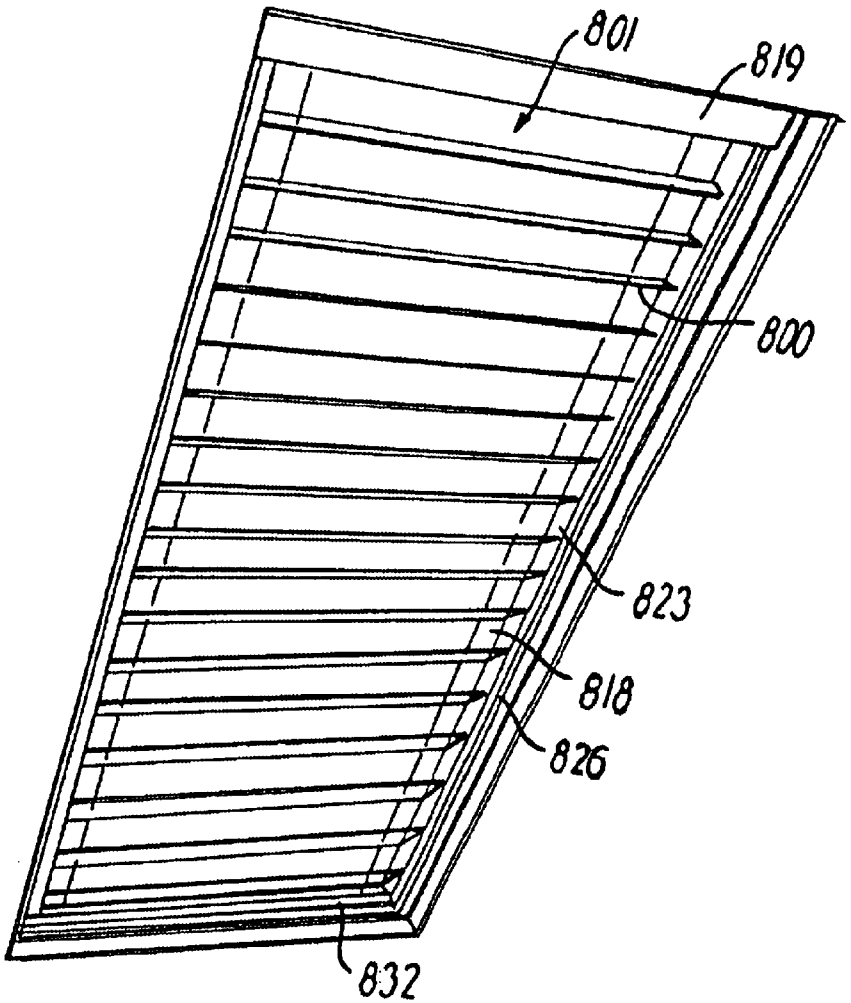
FIG. 23 is a perspective view of a roof window assembly according to the invention with an internal screening accessory.

In a similar way the track 26 formed in the inner side faces 23 of the side members 18 of the main frame component 2 as shown in FIG. 1 facilitates installation of an internal screening arrangement as illustrated in the perspective view in FIG. 23 showing a light screening arrangement in the form of a Venetian blind 800 mounted on the inside of the insulating glazing element of the window component 801. The Venetian blind 800 is secured at one end to the top member 819 of the main frame component 802 and is movable up and down parallel to the side members 818 of the main frame component 802. As for the external screening arrangement shown in FIG. 22, the free end of the blind 800 is connected with an end member 832 provided at either end with engaging means engaging a pair of guide rails 833, which are mounted on the inner side faces 823 of the side members 818 of the main frame component 802 by insertion of a rib part (not shown) into the tracks 826 formed in the inner side faces 823.

In summary, the present invention provides for a programme of various versions of roof window installations and assemblies that may comprise e.g. the following configurations:

- fixed and ventilating versions of installations using only the window component 1 in connection with a curb frame,
- fixed and ventilating versions of a deck-mounted window assembly comprising the window component 1 connected with a main frame component 2 as described in the following; and
- fixed and ventilating versions of a self-flashing window assembly comprising in addition to the window component 1 and the main frame component 2 an integrated flashing component 3.

The invention should not be regarded as being limited to the embodiments described in the above but various modifications and combinations of the shown embodiments may be carried out without departing from the scope of the following claims.

What is claimed is:

1. A window component for use in a roof or skylight window installation, comprising a glazing element with external and internal major surfaces and a closed substantially polygonal perimeter composed of side edges forming angles with each other and a window frame engaging edge zones at said external major surface of the glazing element along all sides thereof, said window frame being made of a continuous single sheet of profile material having throughout the length of the profile material the same substantially L-shaped cross-section consisting of a first profile wall for engagement with said edge zones at said external major surface only of the glazing element and a second profile wall extending generally at substantially right angles to said first profile wall and having an internal side facing the side edges of the glazing element in substantial parallel relationship and with a relatively small clearance thereto, said first profile wall having a shallow trough-shaped cross section between the second profile wall and a first free edge forming a rest for the glazing element, said second profile wall providing at an external side thereof a transverse inwards recess extending in the longitudinal direction of the frame, said glazing element being permanently connected with said window frame solely by a strip of an adhesive compound interposed between each of said edge zones of the external major surface of the glazing element and the first profile wall of the window frame.

2. A window component as claimed in claim 1, wherein said glazing element is an insulating glazing element having at least an outer glass layer and an inner glass layer and a predetermined thickness between said external and internal major surfaces.

3. A window component as claimed in claim 2, wherein the second profile wall is made from sheet metal and said transverse inwards recess is provided by a longitudinal depression from the external side of the second profile wall at a separation from the first profile wall determined by said predetermined thickness of the insulating glazing element, said depression having a bottom section positioned substantially opposite the side edge of the insulating glazing element.

4. A window component as claimed in claim 3, wherein the second profile wall has a second free edge remote from the first profile wall, and has along said second free edge a bent edge flange forming a track extending substantially parallel to said depression.

5. A window component as claimed in claim 4, wherein said window frame includes bending positions along the longitudinal extension for corner junctions between neighboring frame sides, the bending positions being defined by substantially V-shaped cut-outs in said first profile wall, said depression and said bent edge flange towards a common apex line located in the general plane of said second profile wall, the apex angle of each of said cut-outs being determined by a target angle between said neighboring frame sides.

6. A window component as claimed in claim 5, further comprising a locking member insertable in the track formed by said bent edge flange in engagement therewith and with said depression for assembling and locking free ends of said continuous profile for completion of the frame.

7. A window component as claimed in claim 1, wherein at least one elongate connecting member for connection of the window component with a stationary main frame component of a roof window assembly is secured to said second profile wall.

8. A window component as claimed in claim 7, wherein said connecting member is formed with a substantially V-shaped track.

9. A window component as claimed in claim 8, wherein said track is formed with a substantially part-cylindrical bottom face to define a pivot axis allowing said connecting member to function as part of a hinge connection.

10. A window component as claimed in claim 7, wherein the second profile wall is made from sheet metal and said transverse inwards recess is provided by a longitudinal depression from the external side of the second profile wall at a separation from the first profile wall determined by said predetermined thickness of the insulating glazing element, said depression having a bottom section positioned substantially opposite the side edge of the insulating glazing element, said connecting member being positioned against said depression.

11. A window component as claimed in claim 8, wherein said connecting member is formed with a substantially V-shaped track, the window component further comprising a positioning guide member retained between said track and said depression and partly covering an edge zone of said internal major surface and said side edge of the glazing element.

12. A window component as claimed in claim 1, further comprising a gasket member engaging an edge zone of said internal major surface of the glazing element and formed with a retaining part retained in said clearance between the second profile wall and the side edge of the glazing element.

13. A window component as claimed in claim 12, wherein said retaining part is formed with engaging projections engaging the glazing element.

14. A window component as claimed in claim 4, further comprising a gasket member retained in said track formed by the bent edge flange of the second profile wall of the window frame profile and forming a sealing lip for sealing against a stationary main frame of a roof window installation.

15. A window component as claimed in claim 1, wherein said first profile wall is formed with a substantially cylindrical curvature.

16. A window component as claimed in claim 3, wherein said depression is substantially U-shaped.

17. A window component as claimed in claim 16, wherein the bottom section of said depression is a substantially cylindrical curvature.

18. A window component as claimed in claim 16, wherein the bottom section of said depression is substantially flat.

19. A window component as claimed in claim 3, wherein said depression is substantially V-shaped.

20. A window component as claimed in claim 1, wherein said glazing element and said window frame are rectangular.

21. A window component as claimed in claim 1, further comprising an external screening accessory comprising an elongate housing extending along the top member of the window frame, a screening member accommodated in said housing to be retractable therefrom by movement parallel to the side members of the window frame and an end member connected with a free end of said screening member and extending throughout the width of the window component parallel to the top and bottom members of the window frame, engaging means being provided at either end of said end member for engagement with said transverse inwards recess of the second profile wall of each side of the window frame of the window component.

22. A roof window assembly comprising a substantially rectangular window component comprising a glazing element with external and internal major surfaces and a window frame engaging edge zones of said external major surface of the glazing element along all sides thereof, said window frame being made of a continuous single sheet of profile material having throughout the length of the profile material the same substantially L-shaped cross-section consisting of a first profile wall for engagement with said edge zones of said external major surface only of the glazing element and a second profile wall extending generally at substantially right angles to said first profile wall and having an internal side facing side edges of the glazing element in substantial parallel relationship and with a relatively small clearance thereto, said first profile wall having a shallow trough-shaped cross section between the second profile wall and a free edge forming a rest for the glazing element, said second profile wall providing at an external side thereof a transverse inwards recess extending in the longitudinal direction of the frame, said glazing element being permanently connected with said window frame solely by a strip of an adhesive compound interposed between each of said edge zones of the external major surface of the glazing element and the first profile wall of the window frame.

23. The roof window assembly of claim 22, further comprising a main frame component for stationary connection with supporting means of a roof structure and composed of a top member, side members and a bottom member in a rectangular configuration, of which at least the profiles for the top and side members have upper side faces defining a common window plane, the edges zones of said internal major surface of the glazing element of said window component resting against said upper side faces of the main frame component with a gasket member interposed there between.

24. A roof window assembly as claimed in claim 23, wherein the profiles of at least the top and side members of the main frame component have the same cross-section.

25. A roof window assembly as claimed in claim 24, wherein said cross section is shaped generally in the form of a parallelogram with a first pair of substantially parallel sides for forming said upper side face and a lower side face of one of said top and side members and a second pair of substantially parallel sides for forming inner and outer side faces of said top or side member, said second pair of parallel sides being inclined with respect to said first pair with a minor included angle between adjoining sides of said first and second pairs in the range from 40° to 85°.

26. A roof window assembly as claimed in claim 25, wherein said minor included angle is 79°.

27. A roof window assembly as claimed in claim 23, wherein said top, side and bottom members of the main frame component are made of wood profiles connected by mortised joints with a first configuration of mortises and tenors provided at either end of said side members and a second configuration of mortises and tenors provided at either end of the top and bottom members to match said first configuration of mortises and tenors.

28. A roof window assembly as claimed in claim 23, wherein a longitudinal groove is formed in the upper sides of at least said side and top members of the main frame component for retainment of said gasket member.

29. A roof window assembly as claimed in claim 23, wherein each of the top, side and bottom members of the maim frame component is formed in an outer side face with transverse depressions for securing of connecting members for connection with said window frame, mounting members for connecting with at least one of said supporting means of the roof structure and positioning members for temporary positioning of the window assembly with respect to a window opening in the roof structure during installation of the window.

30. A roof window assembly as claimed in claim 29, wherein said depressions comprise two depressions of equal shape located at equal distances from either end of the respective top, side or bottom member of the main frame component.

31. A roof window assembly as claimed in claim 29, wherein each of the side and top members of the main frame component is formed in an outer side face with a relatively narrow longitudinal track at a predetermined distance from the upper side face of each of said members and at least one of each of said connecting members and mounting members is formed with a projecting engagement rib engageable with said track for accurate positioning of said connecting or mounting member in a respective one of said depressions.

32. A roof window assembly as claimed in claim 29, further comprising mounting members for securing to said depressions in the side members of the main frame component for connection of the window assembly to said supporting means of the roof structure.

33. A roof window assembly as claimed in claim 29, further comprising positioning members for arrangement in said depressions in the bottom member to be displaceable between a first position for temporary securing the position of the window assembly with respect to a window opening in the roof structure during installation of the window and a second position retracted from said first position.

34. A roof window assembly as claimed in claim 29, further comprising connecting members for securing to said depressions in the top member of the main frame component for connection of the main frame component with said window frame.

35. A roof window assembly as claimed in claim 34, wherein said connecting members comprise two pairs of first and second elongate connecting members, the first connecting members of said pairs being secured to said depressions in the top member of the main frame component and the second connecting members of said pairs being secured to the second profile wall of the window frame of the window component.

36. A roof window assembly as claimed in claim 35, wherein said first connecting member of each of said pairs comprises a flange part for positioning in and securing to one of said depressions and a projecting elongate engagement part engageable with a substantially V-shaped track formed in said second connecting member of the same pair.

37. A roof window assembly as claimed in claim 36, wherein said engagement part of the first connecting member and said track in the second connecting member are formed engagement surfaces having substantially cylindrical curvatures to define a pivot axis allowing said first and second connecting members to provide a hinge connection between said main frame component and said window component and allow opening of said window component with respect to said main frame component.

38. A roof window assembly as claimed in claim 37, wherein said V-shaped track is formed with an included angle in the range from 20° to 30° to define a correspondingly limited range of ventilation positions of said window component with respect to said main frame component.

39. A roof window assembly as claimed in claim 38, wherein said engagement part of the first connecting member is formed with a longitudinal channel of elongate cross-section, the assembly further comprising spring means having a retaining part received in said longitudinal channel and an engaging member extending substantially at right angles to said retaining part outside a side member of the main frame component to engage the window component to maintain the engagement of the engagement part of the first connecting member in the track of the second connecting member within said range of ventilation positions.

40. A roof window assembly as claimed in claim 37, wherein the bottom member of the main frame component has an upper side face retracted from said common window plane, the assembly further comprising an electric window operator comprising a housing secured to said retracted upper side of the bottom member of the main frame component and an elongate opening member of variable length, part of said opening member being retained in said housing, said opening member comprising an end part connectable with said window component opposite the bottom member of the main frame component.

41. A roof window assembly as claimed in claim 29, wherein said glazing element is an insulating glazing element having at least an outer glass layer and an inner glass layer and a predetermined thickness between said external and internal major surfaces.

42. A window component as claimed in claim 41, wherein the second profile wall is made from sheet metal and said transverse inwards recess is provided by a longitudinal depression from the external side of the second profile wall at a separation from the first profile wall determined by said predetermined thickness of the insulating glazing element, said depression having a bottom section positioned substantially opposite the side edge of the insulating glazing element.

43. A roof window assembly as claimed in claim 34, wherein said second profile wall of the window component is formed along its free edge remote from the first profile wall with a bent edge flange forming a track extending substantially parallel to said depression and the bottom member of the main frame component has an upper side face positioned substantially in said common window plane and connecting members comprising resilient locking members are positioned in and secured to said depressions in the bottom member of the main frame component and formed with a locking part engageable with the bent end flange of the window component to provide locking of the window component with respect to the main frame component.

44. A roof window assembly as claimed in claim 22, wherein the main frame component includes side, top and bottom members, the roof window assembly further comprising a flashing component to provide a weather-proof external joint of the side, top and bottom members of the main frame component with a surrounding roof covering.

45. A roof window assembly as claimed in claim 44, wherein said flashing component comprises a flashing frame composed of interconnected top, side and bottom members of a substantially rigid material arrangeable against external top, side and bottom faces of the main frame component and side flashing sheets projecting from side members of said flashing frame.

46. A roof window assembly as claimed in claim 45, wherein at least the side members of said flashing frame are of a generally L-shaped cross-section comprising a first wall arranged against said external side face of the main frame component and a second wall providing means for securing the window assembly to the roof structure, said projecting side flashing sheets being provided by a flashing collar having a frame part arranged between the first wall of the flashing frame and the main frame component and underlying said second wall of the flashing frame.

47. A roof window assembly as claimed in claim 22, wherein the main frame component includes side members, each side member of said main frame component having an inner side facing a light-admitting area of the window, in which a longitudinal track is formed, which is engageable by a guide rail component for an internal screening accessory.

48. A roof window assembly as claimed in claim 47, further comprising an internal screening accessory comprising a screening member connected with the top member of the main frame component and movable parallel to the side members of the main frame component, an end member connected with a free end of the screening member an extending parallel to the top and bottom members of the main frame component, said end member being provided with engaging means at either end, and a pair of guide rail components engageable with said longitudinal track in the inner side of each side member of the main frame component to provide a guide means for the movement of said screening member by engagement with said engaging means at either end of said end member.

49. A main frame component for use in a roof window assembly for stationary connection of the assembly with supporting means of a roof structure, comprising a top member, side members and a bottom member in a rectangular configuration, of which at least the profiles for the top and side members have the same cross-section including upper side faces defining a common window plane for positioning of a substantially rectangular window component, each of said top, side and bottom members being formed in an outer side face with transverse depressions for securing of connecting members for connection with a window component, mounting members for connecting with at least one of said supporting means of the roof structure and positioning members for temporary positioning of the main frame component with respect to a window opening in the roof structure during installation of the main frame component.

50. A main frame component as claimed in claim 49, wherein said depressions comprise two depressions of equal shape located at equal distances from either end of the respective top, side or bottom member of the main frame component.

51. A main frame component as claimed in claim 50, wherein each of the side and top members of the main frame component is formed in an outer side face with a relatively narrow longitudinal track at a predetermined distance from the upper side face of each of said members, said track being engageable with a projecting engagement rib of each of at least one of said connecting members and mounting members for accurate positioning of said connecting or mounting member in a respective one of said depressions.

52. A main frame component as claimed in claim 49, wherein said cross section is shaped generally in the form of a parallelogram with a first pair of substantially parallel sides for forming said upper side face and a lower side face of one of said top and side members and a second pair of substantially parallel sides for forming inner and outer side faces of said top or side member, said second pair of parallel sides being inclined with respect to said first pair with a minor included angle between adjoining sides of said first and second pairs in the range from 40° to 85°.

53. A main frame component as claimed in claim 52, wherein said minor included angle is 79°.

54. A main frame component as claimed in claim 49, wherein said top, side and bottom members are made of wood profiles connected by mortised joints with a first configuration of mortises and tenors provided at either end of said side members and a second configuration of mortises and tenors provided at either end of the top and bottom members to match said first configuration of mortises and tenors.

55. A main frame component as claimed in claim 49, wherein a longitudinal groove is formed in the upper sides of at least said side and top members, the main frame component further comprising a gasket member retained in said longitudinal groove.

56. A main frame component as claimed in claim 49, wherein each of said side members has an inner side facing a light-admitting area of the window, in which a longitudinal track is formed, which is engageable by a guide rail component for an internal screening accessory.

57. A flashing component for use in a roof window assembly to provide weather-proof external joint of the assembly with a surrounding roof-covering, comprising a flashing frame composed of interconnected top, side and bottom members of a substantially rigid material arrangeable against external top, side and bottom faces of the roof window assembly and side flashing sheets of a resiliently foldable material projecting from the side members of said flashing frame.

58. A flashing component as claimed in claim 57, wherein at least the side members of said flashing frame are of a generally L-shaped cross-section comprising a first wall arranged against said external side face of the main frame component and a second wall providing means for securing the window assembly to the roof structure, said projecting side flashing sheets being provided by a flashing collar having a frame part arranged between the first wall of the flashing frame and the main frame component and underlying said second wall of the flashing frame.

* * * * *